US010197939B2

(12) United States Patent
Kawaguchi

(10) Patent No.: US 10,197,939 B2
(45) Date of Patent: Feb. 5, 2019

(54) IMAGE FORMING APPARATUS WITH A CONTROL THAT COMPENSATES FOR CHANGING HUMIDITY

(71) Applicant: CANON KABUSHIKI KAISHA, Tokyo (JP)

(72) Inventor: Yuji Kawaguchi, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/839,998

(22) Filed: Dec. 13, 2017

(65) Prior Publication Data

US 2018/0113394 A1 Apr. 26, 2018

Related U.S. Application Data

(63) Continuation of application No. 15/270,030, filed on Sep. 20, 2016, now Pat. No. 9,874,830.

(30) Foreign Application Priority Data

Sep. 30, 2015 (JP) ..... 2015-195242

(51) Int. Cl.

| | |
|---|---|
| ***G03G 15/00*** | (2006.01) |
| ***G03G 15/043*** | (2006.01) |
| ***G03G 21/20*** | (2006.01) |
| ***G03G 15/02*** | (2006.01) |

(52) U.S. Cl.

CPC ..... *G03G 15/0266* (2013.01); *G03G 15/043* (2013.01); *G03G 21/203* (2013.01)

(58) Field of Classification Search

CPC . G03G 15/0266; G03G 15/043; G03G 21/203

USPC ..... 399/44, 50, 51, 55

See application file for complete search history.

(56) References Cited

U.S. PATENT DOCUMENTS

| | | | | |
|---|---|---|---|---|
| 7,433,615 | B2 | 10/2008 | Murakami et al. | |
| 7,689,136 | B2 | 3/2010 | Nakase et al. | |
| 9,207,558 | B2 | 12/2015 | Hasegawa et al. | |
| 9,874,830 | B2 * | 1/2018 | Kawaguchi ..... | G03G 15/0266 |

FOREIGN PATENT DOCUMENTS

| | | | |
|---|---|---|---|
| JP | 2000187363 | A | 7/2000 |
| JP | 2007047630 | A | 2/2007 |
| JP | 2008058740 | A | 3/2008 |
| JP | 5511891 | B2 | 6/2014 |

OTHER PUBLICATIONS

Office Action issued in U.S. Appl. No. 15/270,030 dated May 24, 2017.

Notice of Allowance issued in U.S. Appl. No. 15/270,030 dated Sep. 14, 2017.

* cited by examiner

*Primary Examiner* — William J Royer

(74) *Attorney, Agent, or Firm* — Rossi, Kimms & McDowell LLP

(57) ABSTRACT

An image forming apparatus has a control portion configured to control a charging bias to be applied to a charging member and a first exposure amount with respect to humidity inside an image forming apparatus and a thickness of a photosensitive layer of a photoreceptor, and the control portion controls the charging bias and the first exposure amount so that a potential difference between a non-image forming portion and the charging member increases as the humidity decreases, and decreases as the humidity increases.

15 Claims, 21 Drawing Sheets

| ENVIRONMENT | CHARGING ROLLER CONTAMINATION |
|---|---|
| L／L | × |
| H／H | ○ |

FIG.15

| | CHARGING BIAS (-V) | VO(−V) | Vd(−V) | ΔV(V) | POST-PRIMARY TRANSFER POTENTIAL (-V) | CHARGING CONTRAST (V) | CHARGING ROLLER CONTAMINATION |
|---|---|---|---|---|---|---|---|
| EXAMPLE 1 | 1150 | 600 | 530 | 70 | 400 | 750 | ○ |
| COMPARATIVE EXAMPLE 1 | 1130 | 580 | 530 | 50 | 400 | 730 | × |
| COMPARATIVE EXAMPLE 2 | 1140 | 590 | 530 | 60 | 400 | 740 | △ |

FIG.16

| ENVIRONMENT | ABNORMAL SOUND |
|---|---|
| L／L | ○ |
| H／H | × |

FIG.17

| | CHARGING BIAS (-V) | VO(−V) | Vd(−V) | ΔV(V) | ABNORMAL SOUND |
|---|---|---|---|---|---|
| EXAMPLE 1 | 1100 | 580 | 530 | 50 | ○ |
| COMPARATIVE EXAMPLE 3 | 1110 | 590 | 530 | 60 | △ |
| COMPARATIVE EXAMPLE 4 | 1120 | 600 | 530 | 70 | × |

FIG.18

| | X1 | X2 | ··· |
|---|---|---|---|
| W1 | Y1, Z1 | Y2, Z2 | ··· |
| W2 | Y3, Z3 | Y4, Z4 | ··· |
| W3 | Y5, Z5 | Y6, Z6 | ··· |
| W4 | Y7, Z7 | Y7, Z7 | ··· |
| ⋮ | ⋮ | ⋮ | |

W: HUMIDITY

X: FILM THICKNESS OF PHOTOSENSITIVE LAYER

Y: BIAS TO BE APPLIED TO CHARGING ROLLER

Z: EXPOSURE AMOUNT

FIG.21

IMAGE FORMING APPARATUS WITH A CONTROL THAT COMPENSATES FOR CHANGING HUMIDITY

BACKGROUND OF THE INVENTION

Field of the Invention

The present invention relates to an image forming apparatus using electrophotography.

Description of the Related Art

In an image forming apparatus using electrophotography, the surface of a photosensitive drum is charged by a charging roller, and the charged photosensitive drum is exposed by an exposing apparatus, whereby an electrostatic latent image is formed on the photosensitive drum. The electrostatic latent image is developed as a toner image by a developing apparatus, and the toner image is transferred to a recording medium by a transfer roller. Then the toner image transferred to the recording medium is fixed to the recording medium by a fixing apparatus. In this way, an image is formed on the recording medium.

In the case of the image forming apparatus using electrophotography, a charging roller is often used as a means of stably charging the photosensitive drum. The charging roller rotates while contacting the photosensitive drum. The photosensitive drum is charged by a discharge, which is generated in the gap between the charge roller and the photosensitive drum near the contacting part of the charging roller and the photosensitive drum.

If a voltage, higher than a voltage that causes a discharge between the charging roller and the photosensitive drum (discharge start voltage Vth) is applied to the charging roller, a discharge is generated between the charging roller and the photosensitive drum, and the potential of the surface of the photosensitive drum increases. The potential of the surface of the photosensitive drum increases in proportion to the voltage applied to the charging roller. In concrete terms, for example, to set the potential of the surface of the photosensitive drum to a target value Vd, a voltage of "the target value Vd+the discharge start voltage Vth" must be applied to the charging roller. However, if a film thickness of a photosensitive layer becomes thin due to deterioration of the photosensitive drum, the discharge start voltage Vth drops. In the case when the voltage applied to the charging roller is constant, a drop in the discharge start voltage Vth increases the potential of the surface of the photosensitive drum.

Therefore with a technique disclosed in Japanese Patent No. 5511891, the film thickness value of the photosensitive layer of the photosensitive drum is acquired, and, based on the film thickness value of the photosensitive layer, the potential of a non-image forming portion, where no toner image is formed on the photosensitive drum (hereafter called "non-image portion"), is set to a target value. In concrete terms, the charging roller charges the photosensitive drum so that the potential of the entire surface of the photosensitive drum becomes a target value or higher. Then the absolute value of the potential of the non-image portion is lowered by the exposing apparatus exposing the non-image portion at a first output, so that the potential of the non-image portion becomes a target value. Then an electrostatic latent image is formed on the surface of the photosensitive drum by the exposing apparatus exposing at a second output an image forming portion which is the portion on the photosensitive drum where a toner image is formed (hereafter called an "imaging portion").

If the exposing apparatus exposes the surface of the photosensitive drum here, plus charges are generated in a charge-generating layer in the photosensitive drum, as shown in FIG. 19. The plus charges migrate to the surface of the photosensitive drum through a charge-transporting layer. If the surface of the photosensitive drum is exposed with this mechanism, the absolute value of the potential of the surface of the photosensitive drum becomes small. Moreover, when the voltage applied to the charging roller is constant, the potential of the photosensitive drum is also changed by the humidity of the location where the image forming apparatus is used. Therefore according to a technique disclosed in Japanese Patent Application Laid-open No. 2000-187363, the potential of the image portion in the photosensitive drum is set to be constant regardless of the humidity of the location where the image forming apparatus is used.

In the case of the technique disclosed in Japanese Patent No. 5511891, due to high humidity, the discharge amount generated between the photosensitive drum and the charging roller becomes high in a high temperature/high humidity (H/H) environment (temperature: 30° C./humidity: 80%), compared with the case when humidity is low. If the charge amount generated between the photosensitive drum and the charging roller increases, a friction force between the photosensitive drum and a cleaning blade increases. This may result in the minute vibration of the cleaning blade, which may generate an abnormal sound.

In a low temperature/low humidity (L/L) environment (temperature: 15° C./humidity: 10%), due to low humidity the discharge amount generated between the photosensitive drum and the charging roller decreases compared with the case when humidity is high. Moreover, when humidity is low, a hardness of the cleaning blade increases, which makes the contacting state of the surface of the photosensitive drum and the cleaning blade unstable. This may result in toner falling through gaps between the surface of the photosensitive drum and the cleaning blade, which may cause the adherence of toner to the charging roller. Toner that adheres to the charging roller is mainly toner which was not transferred from the photosensitive drum to an intermediate transfer belt or the like. This toner is mainly charged to the positive polarity.

If humidity is low here, the discharge amount generated between the surface of the photosensitive drum and the charging roller becomes low, as mentioned above. Therefore the toner remaining on the photosensitive drum is not sufficiently charged to the negative polarity, and adheres to the charging roller to which the negative polarity voltage is applied. If the toner charged to the positive polarity adheres to the charging roller, the potential of the part on the charging roller where the toner adheres becomes unstable. Because of this, in some cases the photosensitive drum cannot be appropriately charged by the charging roller.

SUMMARY OF THE INVENTION

With the foregoing in view, it is an object of the present invention to minimize the problems that may occur when the discharge amount generated between an image carrier, such as a photosensitive drum, and a charging member, such as a charging roller, is changed due to humidity.

An object of the present invention is to provide an image forming apparatus for forming an image on a recording medium, comprising:

a photoreceptor;

a charging member configured to charge the photoreceptor;

an exposing apparatus configured to form an electrostatic latent image on the photoreceptor by exposing a non-image forming portion of the photoreceptor, which is charged by the charging member, at a first exposure amount so as to have a potential which does not allow adhesion of developer, and exposing an image forming portion of the photoreceptor, which is charged by the charging member, at a second exposure amount so as to have a potential which allows adhesion of developer;

a developing apparatus configured to develop the electrostatic latent image formed on the photoreceptor as a developer image; and a control portion configured to control a charging bias to be applied to the charging member and the first exposure amount with respect to humidity inside the image forming apparatus and a thickness of a photosensitive layer of the photoreceptor, wherein the control portion controls the charging bias and the first exposure amount so that a potential difference between the non-image forming portion and the charging member increases as the humidity decreases, and decreases as the humidity increases.

Further features of the present invention will become apparent from the following description of exemplary embodiments (with reference to the attached drawings).

BRIEF DESCRIPTION OF THE DRAWINGS

FIG. 15 shows the relationship between the humidity in which the image forming apparatus is used and contamination of the charging roller;

FIG. 16 shows the relationship between the potential difference of the non-image portion before and after exposure and contamination of the charging roller;

FIG. 17 shows the relationship between the humidity in which the image forming apparatus is used and the generation of abnormal sound;

FIG. 18 shows the relationship between the potential difference of the non-image portion before and after exposure and the generation of abnormal sound;

FIG. 21 shows a table to determine the charging bias and the exposure amount.

DESCRIPTION OF THE EMBODIMENTS

Embodiments of the present invention will now be described with reference to the drawings. Dimensions, materials and shapes of the components and relative positions thereof, described in the embodiments, should be appropriately changed depending on the configurations and various conditions of the apparatus to which the invention is applied, and are not intended to limit the scope of the invention to the following embodiments.

Example 1

<Image Forming Apparatus>

Figure 1:
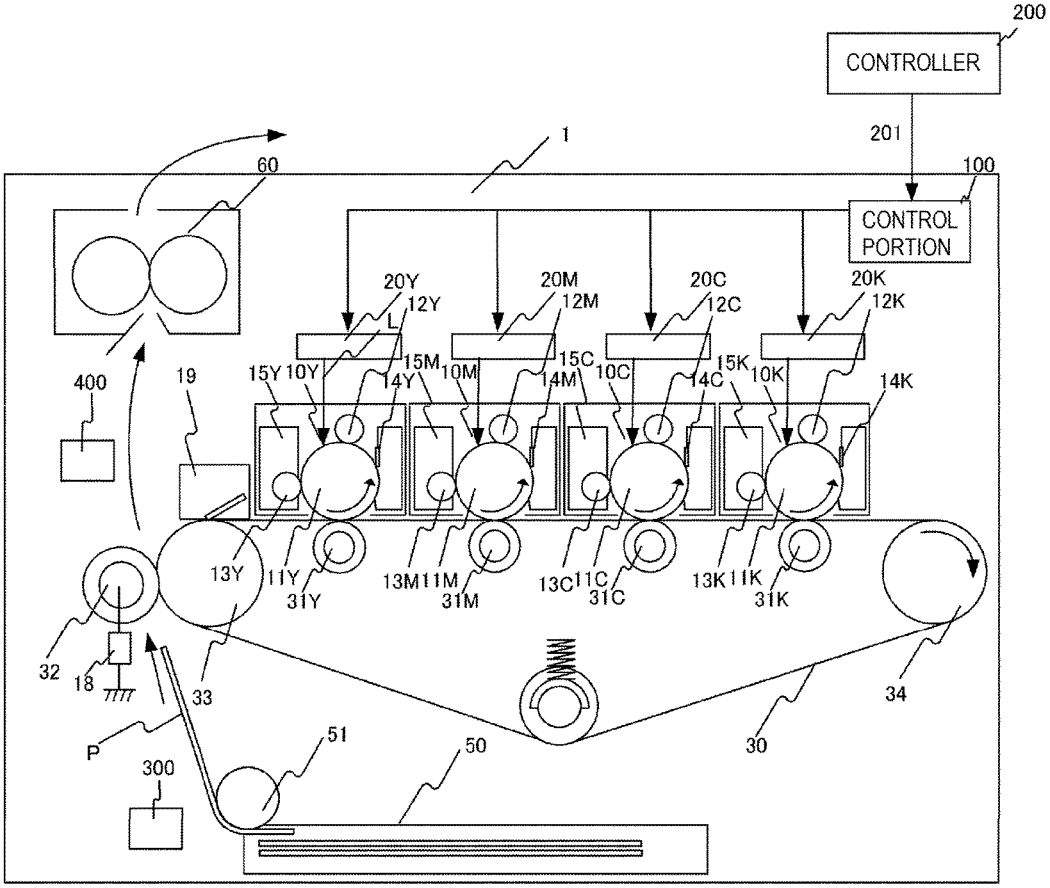
FIG. 1 is a schematic cross-sectional view depicting an image forming apparatus according to Example 1.

An electrophotographic image forming apparatus, such as a copier and a printer, according to Example 1, will be described with reference to FIG. 1. FIG. 1 is a schematic cross-sectional view of the image forming apparatus according to Example 1. In FIG. 1, an image forming apparatus 1 is a laser beam printer using the electrophotographic process. The image forming apparatus 1 forms an image corresponding to image data (electric image information) inputted from a printer controller 200 (external host apparatus) connected to a control portion 100 via an interface 201, on paper P as a recording medium. The control portion 100 controls the operation of the image forming apparatus 1, and sends/receives various electric information signals to/from the printer controller 200. Moreover, the control portion 100 processes electric information signals inputted from various process apparatuses and sensors, processes command signals to various process apparatuses, performs a predetermined initial sequence control, and performs a predetermined image forming sequence. The printer controller 200 is, for example, a host computer, a network, an image reader or a facsimile. The paper P is, for example, a recording paper, an OHP sheet, a postcard, and an envelope.

<Process Cartridge>

In the image forming apparatus 1 shown in FIG. 1, process cartridges 10Y, 10M, 10C and 10K, which function as four image forming units, are disposed in parallel in the horizontal direction (an approximately horizontal direction)

at predetermined intervals. This is the so called "tandem configuration". Here the process cartridge includes at least an electrophotographic type photosensitive drum 11 as a photoreceptor. The photosensitive drum 11 and a process means that operates on the photosensitive drum 11 are integrated in each process cartridge 10. The process cartridges 10Y to 10K have identical configurations except for the toner color. Hence the identical portions of the process cartridges 10Y to 10K are described together while omitting the additional characters Y to K unless a distinction is required.

In this example, the photosensitive drum 11 as an image carrier, a charging roller 12 as a charging member, a developing roller 13 as a developer carrier, and a drum cleaner 14 are integrated in the process cartridge 10. The charging roller 12 is a charging means for uniformly charging the surface of the photosensitive drum 11 at a predetermined potential value. The developing roller 13 is a developing means for carrying and transporting non-magnetic one-component toner (negative charging characteristic), and developing an electrostatic latent image formed on the photosensitive drum 11 as a toner image—a developer image. The drum cleaner 14 is for cleaning the surface of the photosensitive drum 11 after the toner image is transferred. In Example 1, it is assumed that the developing apparatus includes the developing roller 13 and a developer container 15, and is configured to develop an electrostatic latent image on the photosensitive drum 11.

In this example, as the drum cleaner 14, an elastic cleaning blade constituted by a urethane rubber chip blade and sheet metal is used. The drum cleaner 14 is disposed such that the tip portion of the cleaning blade contacts the photosensitive drum 11 in the counter direction with respect to the rotating direction of the photosensitive drum 11. The toner remaining on the surface of the photosensitive drum 11 is scrapped off by the drum cleaner 14, and stored in a waste toner container. The photosensitive drum 11 is rotary-driven by a driving means (not illustrated) in the arrow direction shown in FIG. 1 at about a 150 (mm/sec.) surface moving velocity (peripheral velocity). The photosensitive drum 11 is formed by sequentially stacking a substrate layer, a charge generating layer and a charge transporting layer on an aluminum tube. In this example, the substrate layer, the charge generating layer and the charge transporting layer are collectively described as a "photosensitive layer".

Each process cartridge 10Y to 10K has a same configuration except for the color of the toner stored in the developer container 15. A toner image of yellow (Y), magenta (M), cyan (C) and black (K) is formed respectively in each process cartridge 10Y, 10M, 10C and 10K. Each process cartridge 10Y to 10K is removably attached to the main unit of the image forming apparatus 1. For example, when toner in the developer container 15 is consumed, each process cartridge 10Y to 10K can be replaced.

Figure 2:
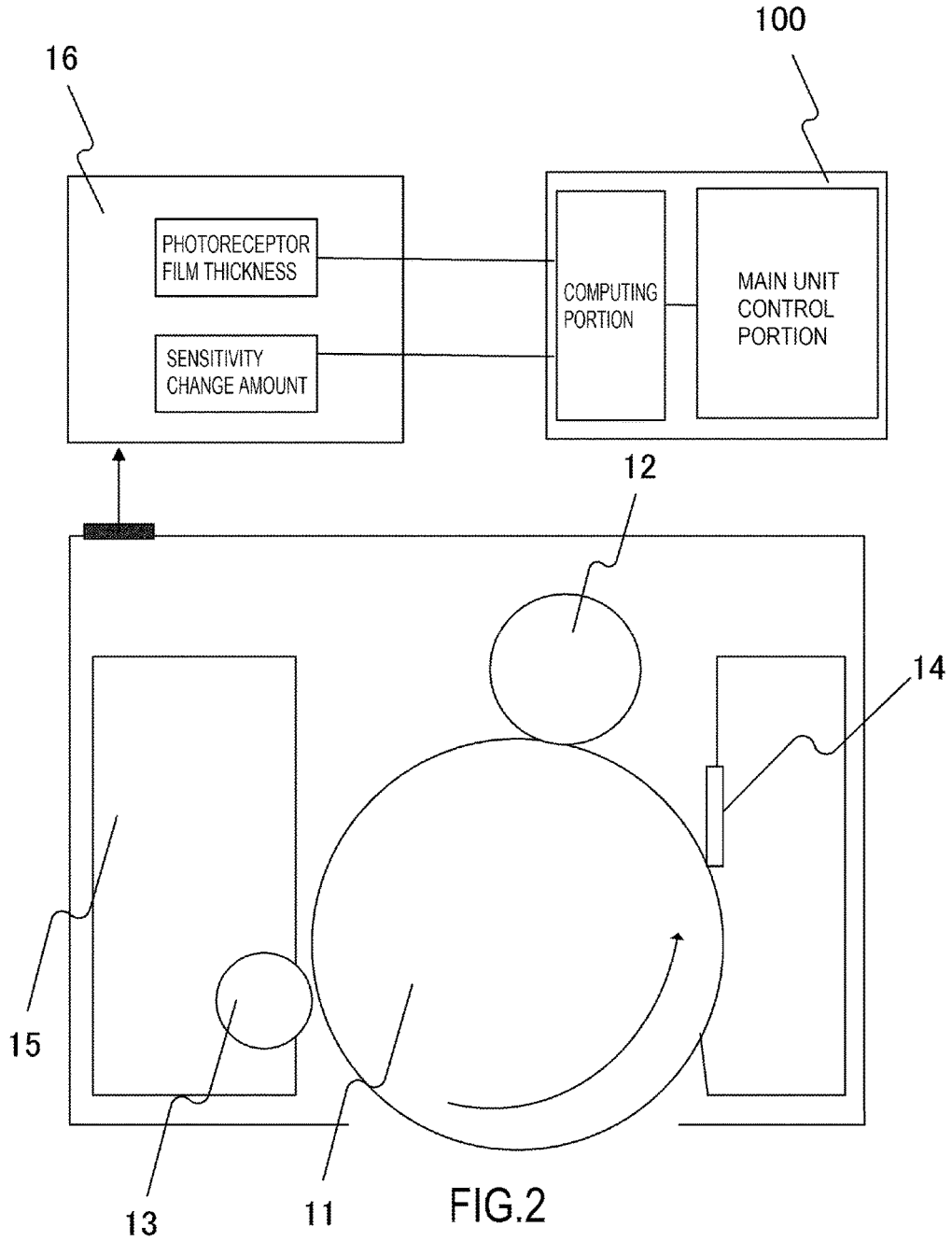
FIG. 2 is a schematic cross-sectional view depicting a process cartridge according to Example 1.

FIG. 2 is a schematic cross-sectional view of the process cartridge according to Example 1. A cartridge memory 16 (16Y, 16M, 16C or 16K) (see FIG. 3) is disposed in each process cartridge 10Y to 10K as a storing portion. For the cartridge memory 16, a contact type non-volatile memory, a non-contact type non-volatile memory, a volatile memory having a power supply can be used, for example. In this example, a non-contact type non-volatile memory is included in the process cartridge 10 as a storing means.

The non-contact type non-volatile memory has an antennae (not illustrated), which is an information transfer means on the memory side, and can read and write information by communicating with the control portion 100 on the main unit side of the image forming apparatus 1 via wireless. In this example, the control portion 100 includes a computing portion, a storing portion (ROM) and a clock, and can read/write information to/from the cartridge memory 16 via the information transfer means on the apparatus main unit side.

When the photosensitive drum 11 is new, information on a new photosensitive drum 11 is stored in the cartridge memory 16. This information is, for example, a film thickness of the photosensitive layer of the new photosensitive drum 11 (initial photosensitive layer film thickness) and a sensitivity of the new photosensitive drum 11 (initial sensitivity). This information is stored in the cartridge memory 16 when the photosensitive drum 11 is manufactured. When necessary, the cartridge memory 16 can read or write the information on the photosensitive drum 11 (information on the film thickness of the photosensitive layer and on the change amount of the sensitivity), which changes along with the use of the photosensitive drum 11.

The developing roller 13 as a developer carrier has a core bar, and a conductive elastic body layer which is concentrically formed around the core bar. The developing roller 13 is disposed approximately in parallel with the photosensitive drum 11. The developing roller 13 carries and transports the toner, which was charged to the negative polarity by friction, to the developing position facing the photosensitive drum 11. The developing roller 13 is contacted to or separated from the photosensitive drum 11 by a contacting mechanism (not illustrated). During the image forming step, the developing roller 13 contacts the photosensitive drum 11, and about a −400V DC bias voltage is applied to the core bar of the developing roller 13 as the development bias.

<Operation of Image Forming Apparatus>

In the image forming apparatus 1 of this example, laser exposing units 20Y, 20M, 20C and 20K, which function as exposing apparatuses to expose the photosensitive drums 11 disposed in the process cartridges 10Y to 10K respectively, are disposed as an exposing system. A time series electric digital pixel signal of the image-processed image information is inputted to the laser exposing unit 20. This time series electric digital pixel signal is inputted from the printer controller 200 to the control portion 100 via the interface 201.

The laser exposing unit 20 includes a laser outputting portion configured to output a laser beam, which is modulated responding to the inputted time series electric digital pixel signal, a rotating polygon mirror, an fθ lens, a reflecting mirror and the like. The laser exposing unit 20 performs the main scanning exposure on the surface of the photosensitive drum 11 using the laser beam L. An electrostatic latent image corresponding to the image information is formed on the surface of the photosensitive drum 11 by the main scanning exposure by the laser exposing unit 20 and sub-scanning by the rotation of the photosensitive drum 11.

The charging roller 12, which functions as a contact type charging means, includes a core bar and a conductive elastic layer which is concentrically formed around the core bar. The charging roller 12 is disposed approximately in parallel with the photosensitive drum 11, and contacts the photosensitive drum 11 at a predetermined pressing force in resistance to the elasticity of the conductive elastic layer. Both end portions of the core bar of the charging roller 12 are rotatably supported by bearings, so that the charging roller 12 rotates following the rotation of the photosensitive drum 11. In this example, the charging bias is applied to the core bar of the charging roller 12.

On the other hand, in the image forming apparatus 1 according to this example, an intermediate transfer belt 30, which is a second image carrier, is disposed so as to contact the photosensitive drum 11 of the process cartridge 10. For the intermediate transfer belt 30, an endless belt of resin film, of which electric resistance value (volume resistivity) is about $10^{11}$ to $10^{16}$ (Ω·cm) and thickness is 100 to 200 μm, is used. Materials that can be used for the intermediate transfer belt 30 are polyvinylidene fluoride (PVdf), nylon, polyethylene terephthalate (PET), polycarbonate (PC) and the like.

The intermediate transfer belt 30 is installed between a driving roller 34 and a secondary transfer counter roller 33, and is circulated at a process velocity by the driving roller 34 that is rotated by a motor (not illustrated). A primary transfer roller 31 is a roller having a conductive elastic layer formed on a shaft, and is disposed approximately in parallel with the photosensitive drum 11. The primary transfer roller 31 contacts the photosensitive drum 11 at a predetermined pressing force via the intermediate transfer belt 30. The DC bias voltage of the positive polarity is applied to the shaft of the primary transfer roller 31, whereby a transfer electric field is formed between the photosensitive drum 11 and the primary transfer roller 31. The shape of the primary transfer roller 31 is not especially limited if the primary transfer can be appropriately performed from the photosensitive drum 11 to the intermediate transfer belt 30. The shape of the primary transfer roller 31 may be a pad shape or a brush shape, for example.

A toner image of each color formed on each photosensitive drum 11 is sent to the primary transfer position by the photosensitive drum 11 as it further rotates in the arrow direction shown in FIG. 1. The toner image on the photosensitive drum 11 is sequentially primary-transferred onto the intermediate transfer belt 30 by the primary transfer electric field formed between the primary transfer roller 31 and the photosensitive drum 11. In this case, the toner images of the four colors are sequentially superimposed on the intermediate transfer belt 30.

Primary transfer residual toner that remains on the photosensitive drum 11 after the primary transfer is cleaned off by the drum cleaner 14. The primary transfer residual toner that is removed from the surface of the photosensitive drum 11 by the drum cleaner 14 is stored in a waste toner container. The surface of the photosensitive drum 11 is cleaned in this manner. For the primary transfer of the toner image to be constantly performed well, with satisfying such conditions as high transfer efficiency and low retransfer rate, the bias of the positive polarity that is applied by the primary transfer bias power supply must always be controlled to an optimum value considering the environment and characteristics of the parts. This control is performed by a control means (not illustrated).

The four color toner images on the intermediate transfer belt 30 are transferred in batch to the surface of the paper P, fed by a recording material supplying apparatus 51, when the secondary transfer voltage is applied to a secondary transfer roller 32 by a secondary transfer high voltage power supply 18, in the process of the toner images passing through the secondary transfer portion. The recording material supplying apparatus 51 ejects the paper P, which is the recording material stacked in a paper cassette 50, at a predetermined timing, and transports it. In this example, the configuration for transferring the toner images on the photosensitive drum 11 onto the paper P (a primary transfer roller 31, a secondary transfer roller 32 and the like) is called a "transfer member".

The secondary transfer residual toner which remains on the intermediate transfer belt 30, after the secondary transfer, is scraped off by a transfer cleaning apparatus 19 contacting the intermediate transfer belt 30. Then the paper P carrying the four color toner images is guided to a fixing apparatus 60. The four color toner images are melted and mixed by the paper P that is heated and pressed, and are fixed to the paper P. A full color print image is formed on the paper P by the above image forming operation.

<Laser Exposing Unit>

Figure 3:
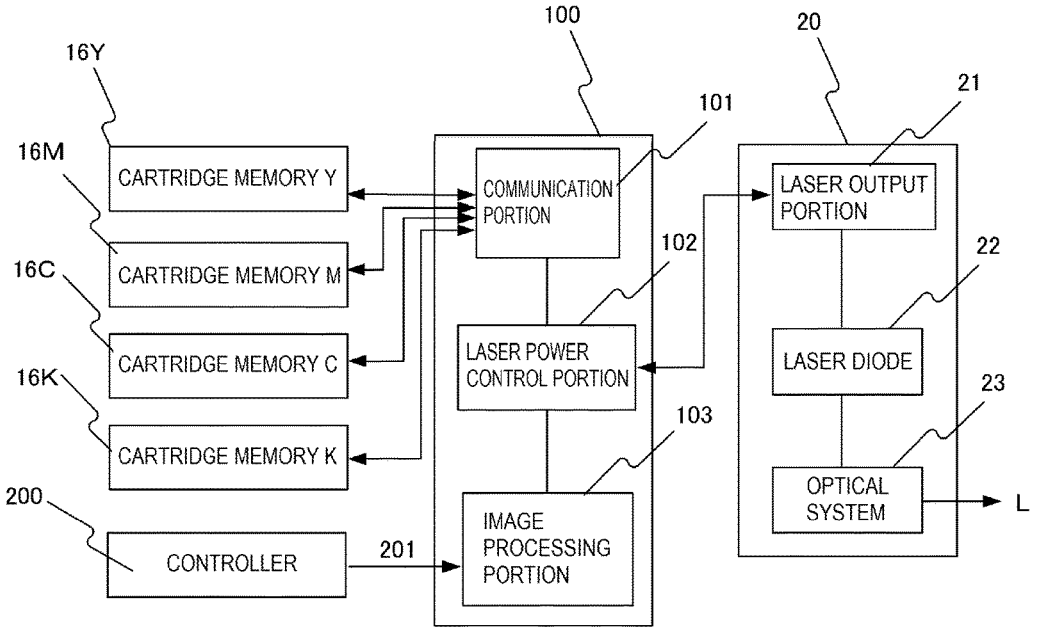
FIG. 3 is a block diagram depicting a hardware configuration of a laser power control system.

FIG. 3 is a block diagram depicting a hardware configuration of the laser power control system. The laser exposing unit 20 according to this example will be described with reference to FIG. 3. The laser exposing unit 20 according to this example can switch the laser output to expose the surface of the photosensitive drum 11 between a first laser power (E1) and a second laser power (E2). In this example, the laser exposing unit 20 changes the exposure amount to the surface of the photosensitive drum 11 by changing the laser power, without changing the time of exposing the surface of the photosensitive drum 11.

A laser power control portion 102, to independently control each laser power, is disposed in the control portion 100. Here an image signal sent from the printer controller 200 is a multi-value signal (0 to 255) which has 8 bits=256 grayscales in the depth direction. The laser beam is OFF when this image signal is 0, is completely ON (all lit) when this image signal is 255, and becomes in the middle thereof (midway between completely ON and OFF) when the image signal is 1 to 254.

In this example, an image signal sent from the printer controller 200 is converted into a serial time series digital signal by an image processing portion 103. In the image processing portion 103, the time series digital signal is controlled in 256 levels by using the area gradation based on a 4×4 dither matrix, and by the laser pulse width modulation controlling the laser emission time of each dot pulse (600 dots/inch).

A communication portion 101 reads information on the film thickness and sensitivity of each photosensitive drum 11 stored in the memory 16Y to 16K of each process cartridge 10. Then a laser power signal selected according to the state of each photosensitive drum 11Y to 11K and an image data signal corresponding to each process cartridge 10Y to 10K are sent from the laser power control portion 102 to each laser exposing unit 20Y to 20K. A laser output portion 21 switches the laser power in accordance with the selection signal inputted from the laser power control portion 102, and turns each laser diode 22 ON. The laser emitted from the laser diode 22 is irradiated onto each photosensitive drum 11Y to 11K as a laser beam L via an optical system 23 including a polygon mirror.

In this example, the laser power control portion 102 independently controls the first laser power (E1) and the second laser power (E2) for each process cartridge 10Y to 10K. The first laser power (E1) is laser power for forming dark portion potential (non-image portion potential Vd) to prevent the adhesion of toner to the non-image region (non-image portion) on the surface of the photosensitive drum 11. By the laser exposing unit 20 exposing the photosensitive drum 11 with the first laser power (E1), the photosensitive drum 11 is exposed at a first exposure value, and the surface potential of the photosensitive drum 11 charged by the charging roller 12 is attenuated to the dark portion potential. The second laser power (E2) is laser power for forming bright portion potential (image portion potential VI) to allow toner to adhere to the image region (image portion) on the surface of the photosensitive drum 11. By the laser exposing unit 20 exposing the photosensitive drum 11 with the second laser power (E2), the photosensitive drum 11 is exposed at a second exposure value, and the surface potential of the photosensitive drum 11 charged by the charging roller 12 is attenuated to the bright portion potential.

According to this example, in the image forming step, a weak laser beam is emitted by allowing a predetermined bias current to be supplied to the laser diode 22. The power of the laser at this time is assumed to be the first laser power (E1). The power of the laser, when bias current greater than the above predetermined bias current is supplied to the laser diode 22, is assumed to be the second laser power (E2). The laser power control portion 102 controls the laser powers E1 and E2 by changing the amount of current to be supplied to the laser diode 22.

<Potential Setting for Exposure>

Figure 4:
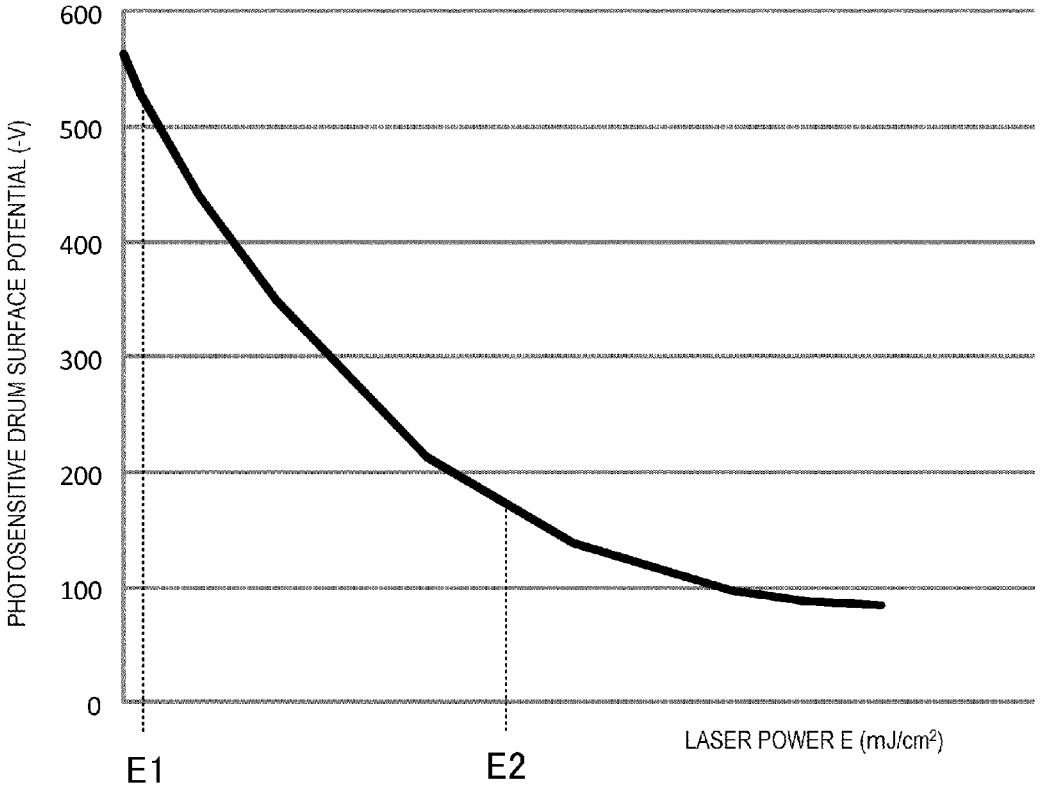
FIG. 4 is a diagram showing the relationship between the potential of the surface of a photosensitive drum and a laser power.
Figure 5:
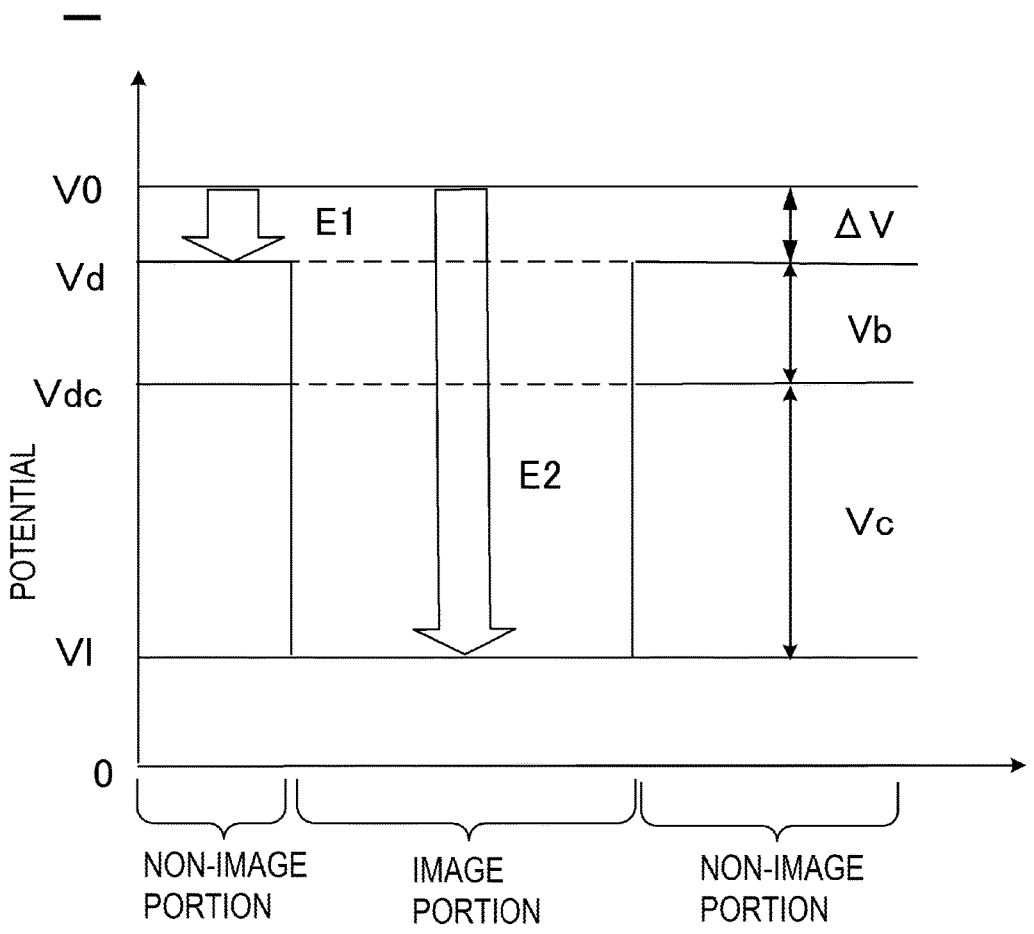
FIG. 5 is a diagram showing the potential of the image portion and the potential of the non-image portion on the surface of the photosensitive drum.

The potential of the image portion and the potential of the non-image portion on the surface of the photosensitive drum 11 will be described with reference to FIG. 4 and FIG. 5. FIG. 4 is a diagram showing the relationship between the potential of the surface of the photosensitive drum 11 and the laser power. FIG. 5 is a diagram showing the potential of the image portion and the potential of the non-image portion on the surface of the photosensitive drum 11. The photosensitive drum 11 according to this example is constituted by a cylindrical base body made of aluminum, and an organic photoconductor (OPC) photosensitive layer covering the surface of the base body.

FIG. 4 is a diagram showing the relationship between the potential of the surface of the photosensitive drum 11 and the laser power (hereafter called "E-V curve"), in the case when the photosensitive drum 11, of which initial film thickness of the photosensitive layer is 18 (μm), is exposed at a predetermined laser power. The photosensitive drum 11 is charged by the charging roller 12 to which about a −1150 (V) DC voltage is applied. The potential of the surface of the photosensitive drum 11, after the photosensitive drum 11 is charged by the charging roller 12, is assumed to be a primary charging potential V0. In FIG. 4, the primary charging potential V0 is about −580 V.

In FIG. 4, the abscissa of the graph indicates a laser power E ($\mu J/cm^2$) of the laser which is irradiated onto the surface of the photosensitive drum 11. A portion on the surface of the photosensitive drum 11 where a toner image is formed is assumed to be the image portion, and a portion on the surface of the photosensitive drum 11 where a toner image is not formed is assumed to be the non-image portion. In FIG. 4, the laser exposing unit 20 exposes the image portion on the photosensitive drum 11 at the second laser power E2 ($\mu J/cm^2$). Thereby the potential of the image portion is set to an image portion potential VI (about −170 V).

At the same time, the non-image portion (referred to as background) on the photosensitive drum 11 is exposed at the first laser power E1 ($\mu J/cm^2$). Thereby the potential of the non-image portion is set to the non-image portion potential Vd (about −510 V). The potential change from V0 to Vd here is assumed to be the potential change ΔV (=|V0−Vd|). About a −360 V DC bias voltage is applied to the developing roller 13. Therefore the negatively charged toner on the developing roller 13, transported to the developing position, adheres to the portion where the potential of the photosensitive drum 11 is the image portion potential VI, because of the potential contrast between the image portion potential VI on the photosensitive drum 11 and the development bias Vdc. As a result, the image portion (electrostatic latent image) is developed as the toner image.

In the image forming apparatus 1 according to this example, the charging roller 12 charges the photosensitive drum 11 to the negative polarity (minus). In other words, a reversal development system, in which development is performed with the toner charged to the negative polarity (minus), is used. Therefore the region exposed at the second laser power E2 becomes the image portion, and the region exposed at the first laser power E1 becomes the white portion (non-image portion). The non-image information portion is the so called "background region".

In FIG. 5, the primary charging potential V0 is a potential of the surface of the photosensitive drum 11 charged by the charging roller 12. Development contrast Vc, which is the difference between the image portion potential VI and the development bias Vdc, becomes the factor to determine the image density and gradation of the image portion. In other words, if the development contrast Vc becomes small, sufficient image density and gradation cannot be acquired. Therefore the development contrast Vc must be a predetermined value or higher.

White portion contrast Vb, which is a difference between the development bias Vdc and the non-image portion potential Vd, becomes a factor to determine the fogging (background staining) in the white portion. In other words, if the white portion contrast Vb increases and exceeds a predetermined value, the reversely charged toner (positively charged toner) adheres to the white portion, and generates fogging. This causes image staining and contamination inside the apparatus. If the white portion contrast Vb decreases and becomes less than a predetermined value, normally charged toner (negatively charged toner) is developed on the white portion, and fogging is generated. As a consequence, the white portion contrast Vb must be set to be within a predetermined range. Although details will be described later, in this example, the exposure amount of the laser exposing unit 20 and the bias to be applied to the charging roller 12 are adjusted in accordance with the film thickness of the photosensitive drum 11 and the absolute humidity. Thereby not only the primary charging potential V0 and the non-image portion potential Vd, but the development contrast Vc and the white portion contrast Vb are also set to optimum values.

<Environmental Sensor>

In this example, an environmental sensor 300, which functions as a humidity sensor, is installed near a paper feeding unit portion (e.g. the recording material supplying apparatus 51). To calculate temperature using the environmental sensor 300, the control portion 100 uses an ASIC to acquire the AD value by AD-converting the voltage inputted from the environmental sensor 300 to the ASIC. The detection result by the environmental sensor 300 is acquired as a 10-bit AD value.

The AD values are sampled as 10 msec. intervals, and the sampled AD values are converted into environmental temperature in 0.1° C. units. When this conversion into environmental temperature is performed ten times (every 100 msec.), an average value of the sampled environmental temperature values at 6 points, out of the sampled 10 points in the previous 100 msec. is calculated, excluding the two highest values and the two lowest values. Then this average value is used as the current temperature value (in 0.1° C. units), and the value generated by rounding to the first decimal place of this value is held in RAM (not illustrated) as the current temperature value (in 1° C. units). Further, the environmental sensor 300 estimates the temperature in the image forming apparatus 1 which rises by the influence of the temperature rise caused by the image forming operation, and performs control to correct the environmental temperature. Since the actual operating temperature shifts from the ambient temperature of the environment by the influence of the temperature rise in the image forming apparatus 1, the environmental sensor 300 corrects the environmental temperature and controls so that optimum temperature values can be used.

On the other hand, to calculate the humidity by the environmental sensor 300, the control portion 100 uses the ASIC to acquire the AD value by AD-converting the voltage inputted from the environmental sensor 300 to the ASIC. The detection result by the environmental humidity sensor is acquired as a 10-bit AD value by the AD conversion of the ASIC. The environmental humidity (%) is calculated by the average of the environmental humidity sensor AD values and the environmental temperature (° C.), and is updated at 100 msec. intervals. When the environmental humidity sensor AD values are sampled ten times at 10 msec. intervals, an average value of the sampled environmental humidity sensor AD values at 6 points out of 10 sampled points is calculated, excluding the two highest values and the two lowest values. Thereby the environmental humidity sensor AD average value is calculated.

Then the environmental humidity RH5(%) at 5° C. of the environmental humidity sensor AD average value and the environmental humidity RH50(%) at 50° C. of the environmental humidity sensor AD average value are acquired. The environmental humidity (%) is calculated by the following Expression 1, using RH5(%), RH50(%) and the environmental temperature T (° C.).

$$\text{Environmental humidity (\%)} = \text{RH50} + (50 - T) \times ((\text{RH5} - \text{RH50})/(50 - 5)) \quad \text{(Expression 1)}$$

For the environmental temperature T, a value of which significant figures are rounded down to the first decimal place is used. For the environmental humidity, a value generated by rounding the first decimal place is used. The calculated environmental humidity (%) is held in RAM at the next update timing.

Then the absolute humidity is calculated from the environmental humidity. The absolute humidity (g/m$^3$) is determined based on the environmental temperature T (° C.) and the environmental humidity RH (%). The absolute humidity (g/m$^3$) is acquired based on the saturated moisture amount Wmax (g/m$^3$) at the environmental temperature T (° C.). The absolute humidity (g/m$^3$) is calculated by the following Expression 2, using the saturated moisture amount Wmax (g/m$^3$) and the environmental humidity RH (%).

$$\text{Absolute humidity (g/m}^3) = W\text{max} \times (\text{RH}/100) \quad \text{(Expression 2)}$$

The update timing of the absolute humidity is assumed to be the same as the calculation timing of the average value of the environmental humidity. In the description on the environmental temperature and humidity, it is defined that L/L is temperature: 15%/humidity: 10%, N/N is temperature: 23%/humidity: 50%, and H/H is temperature: 30° C./humidity: 80%.

<Measurement of Film Thickness>

In the image forming apparatus 1, a paper feed sensor 400 (see FIG. 1), configured to detect the passage of the paper P at a predetermined position in the image forming apparatus 1, is disposed. In this example, the film thickness of the photosensitive layer of the photosensitive drum 11 is measured based on the number of fed sheets. The control portion 100 integrates the number of fed sheets based on the signal inputted from the paper feed sensor 400, and stores the result in the cartridge memory 16. In the cartridge memory 16, a table, that indicates the correspondence between the film thickness of the photosensitive drum 11 and a number of fed sheets is stored in advance. The control portion 100 acquires the film thickness of the photosensitive drum 11 or a value related to the film thickness from the correspondence between the film thickness of the photosensitive drum 11 and a number of fed sheets.

<Difference of Sensitivity Depending on Film Thickness of Photosensitive Drum>

Figure 6:
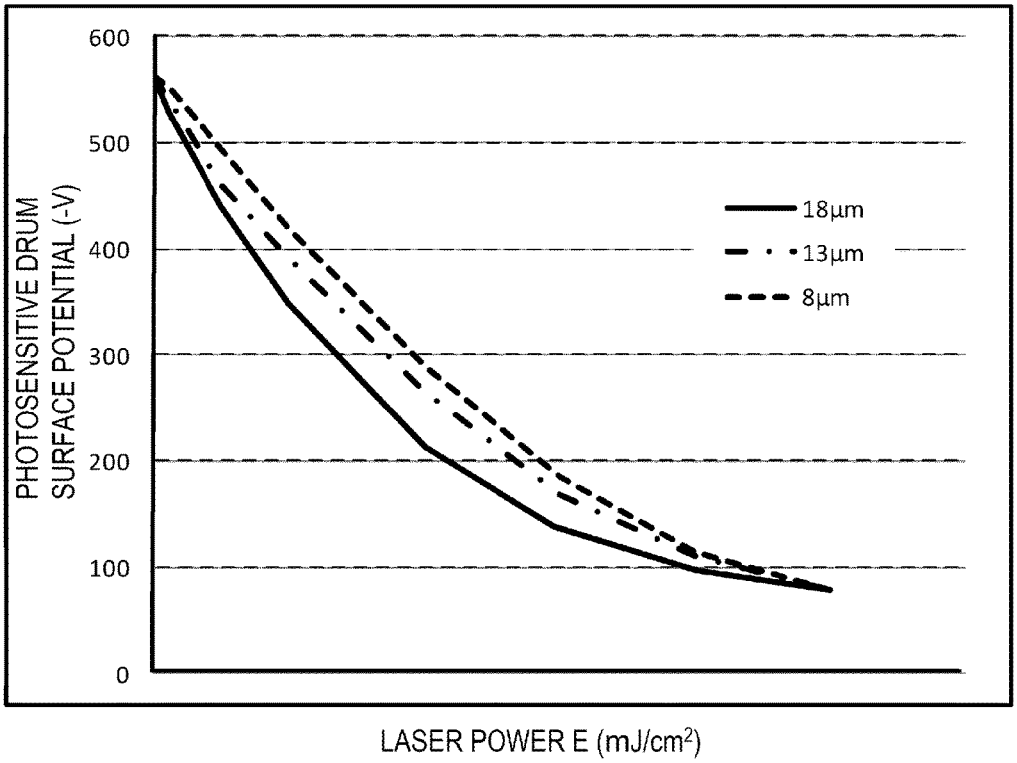
FIG. 6 is a diagram showing the relationship between the potential of the surface of the photosensitive drum and the laser power.

Now the change characteristics of the E-V curve of the photosensitive drum 11 will be described. FIG. 6 is a diagram showing the relationship between the potential of the surface of the photosensitive drum and the laser power for each film thickness of the photosensitive layer. The photosensitive layer on the surface of the photosensitive drum 11 repeatedly receives discharge by the printing operation, and is rubbed by the drum cleaner and the developing roller 13. Thereby the photosensitive layer of the photosensitive drum 11 wears down. As a result, the film thickness of the photosensitive layer of the photosensitive drum 11 decreases, and the potential of the surface of the photosensitive drum 11 changes.

In FIG. 6, the primary charging potential V0 of each photosensitive drum 11, having a different film thickness of photosensitive layer (potential of the surface of each charged photosensitive drum 11), is the same. As shown in FIG. 6, the slope of the E-V curve decreases as the film thickness of the photosensitive layer decreases, since the charge density of the surface of the photosensitive drum 11 increases. In other words, the potential of the photosensitive drum 11 changes due to the time-based deterioration of the film thickness of the photosensitive layer, and the film thickness of the photosensitive layer at manufacturing (initial film thickness). In this example, in order to handle such change in the potential, the exposure value of the laser exposing unit 20 is corrected in accordance with the film thickness of the photosensitive drum 11. This correction will be described in detail later.

<Change of Primary Charging Potential Depending on Absolute Humidity>

Figure 7:
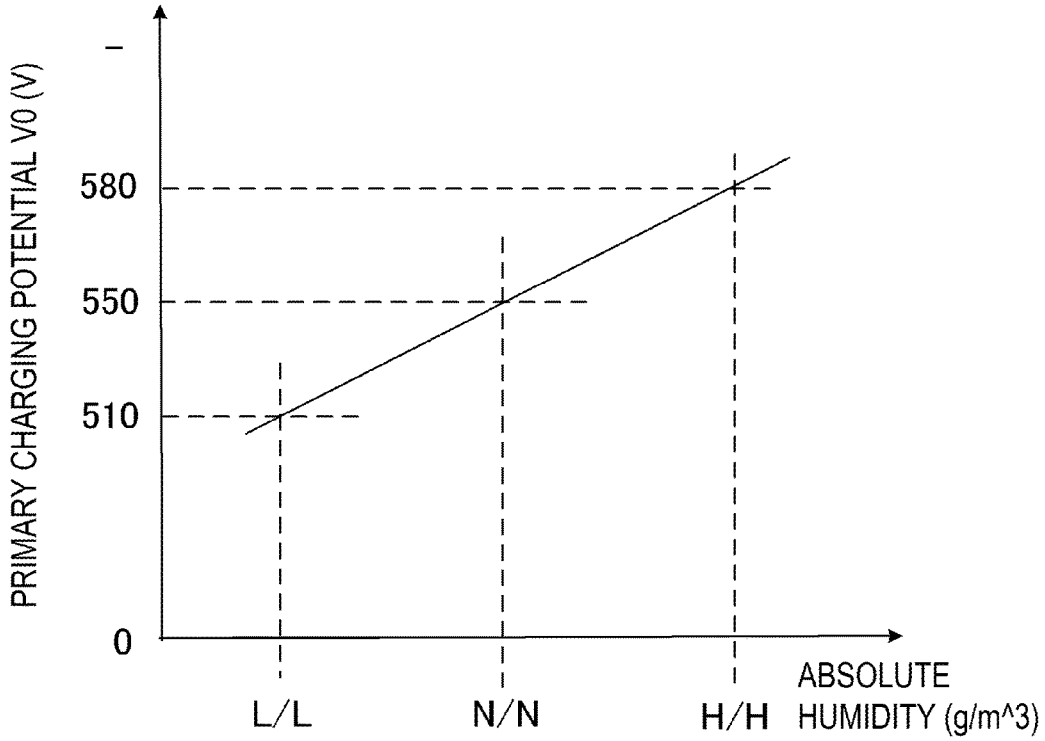
FIG. 7 is a diagram showing the relationship between the potential of the surface of the charged photosensitive drum and the absolute humidity.
Figure 8:
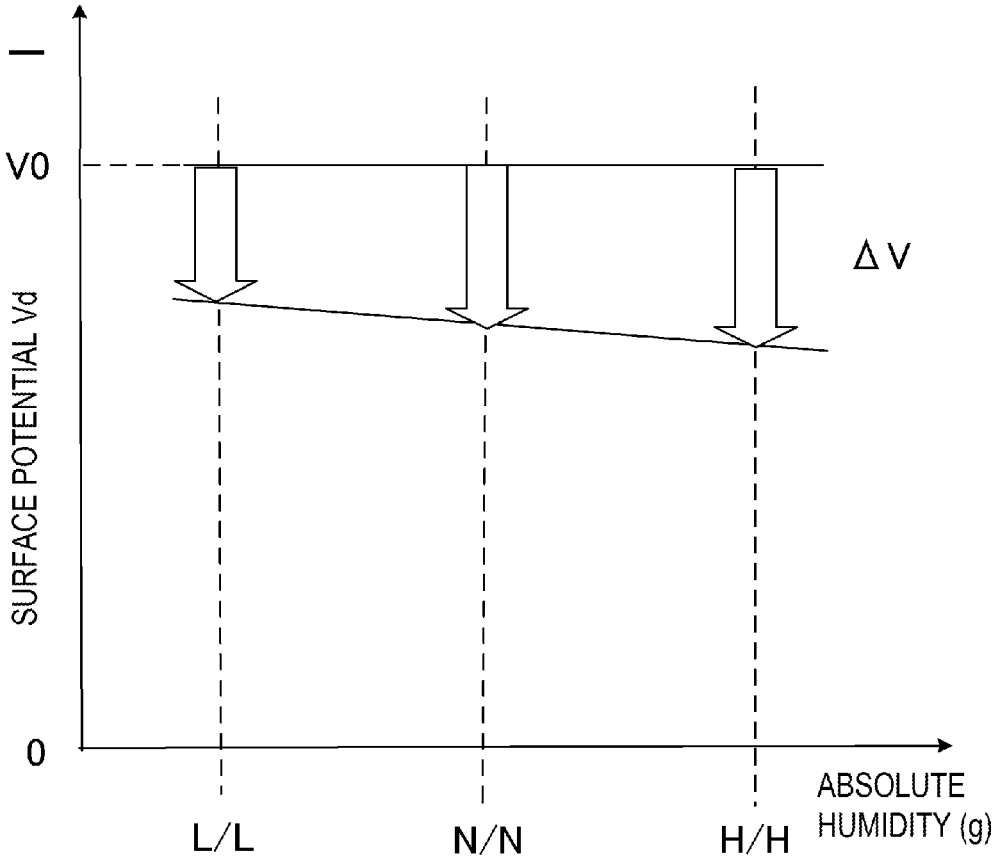
FIG. 8 is a diagram showing the relationship between the potential of the non-image portion of the photosensitive drum and the absolute humidity.

The change of the discharge amount that the photosensitive drum 11 receives from the charging roller 12, depending on the absolute humidity, will be described next with reference to FIG. 7 and FIG. 8. FIG. 7 is a diagram showing the relationship between the potential of the surface of the charged photosensitive drum 11 (primary charging potential V0) and the absolute humidity. FIG. 8 is a diagram showing the relationship between the potential of the non-image portion of the photosensitive drum 11 and the absolute humidity. If the absolute humidity changes, the discharge start voltage Vth changes even if the same charging bias is applied to the charging roller 12, hence the primary charging potential V0 of the surface of the photosensitive drum 11 changes. Here the primary charging potential V0 generated on the surface of the photosensitive drum 11 is lower in the L/L environment and higher in the H/H environment.

FIG. 7 shows the value of the primary charging potential V0, when the charging bias to be applied to the charging roller 12 is fixed to −1120 V, in the photosensitive drum 11, of which film thickness of the photosensitive layer is 18 μm. As shown in FIG. 7, when the film thickness of the photosensitive drum 11 is the same, the primary charging potential V0 changes depending on the environment even if the same charging bias is applied to the charging roller 12. In other words, in order to make the primary charging potential V0 constant, the charging bias to be applied to the charging roller 12 must be higher in the L/L environment than in the H/H environment. In FIG. 7, in order to make the primary charging potential V0 constant, a charging bias that is about 70 V higher, on the basis of an absolute value, must be applied to the charging roller 12 in L/L environment (temperature: 15° C./humidity: 10%) than in H/H environment (temperature: 30° C./humidity: 80%).

Further, the sensitivity of the photosensitive drum 11, with respect to the exposure from the laser exposing unit 20, is also different depending on the absolute humidity. As the absolute humidity is higher, the amount of charges generated in a charge generating layer of the photosensitive layer increase, and the movement of the charges in the charge transporting layer is faster. Therefore, as shown in FIG. 8, even if the bias to be applied to the charging roller 12 is adjusted so that the primary charging potential V0 becomes constant, the non-image portion potential Vd becomes different depending on the absolute humidity when the exposure amount from the laser exposing unit 20 to the non-image portion is the same.

In other words, the potential change ΔV (=|V0−Vd|) changes depending on the absolute humidity. Therefore in order to make the potential change ΔV the same even if the environment changes, the exposure amount to the non-image portion must be increased when the absolute humidity is low, compared with the case when the absolute humidity is high. In this example, the exposure amount to the non-image portion is changed in order to make the potential change ΔV the same regardless of the environment. Further, in this example, the exposure amount of the laser exposing unit 20 and the bias to be applied to the charging roller 12 are corrected in accordance with the detection result of the environmental sensor 300, in order to adjust for the changes in the absolute humidity. This correction will be described later.

<Latent Image Setting when Film Thickness of Photosensitive Drum Changes>

In this example, the exposure amount of the laser exposing unit 20 is changed in accordance with the film thickness of the photosensitive layer of the photosensitive drum 11 and the absolute humidity. First a case when the film thickness of the photosensitive drum 11 changed will be described. When the bias to be applied to the charging roller 12 is fixed to a predetermined value, the primary charging potential V0 increases as the film thickness of the photosensitive layer decreases. This is because the discharge start voltage Vth, between the charging roller 12 and the photosensitive drum 11, decreases as the film thickness of the photosensitive layer decreases.

Figure 9:
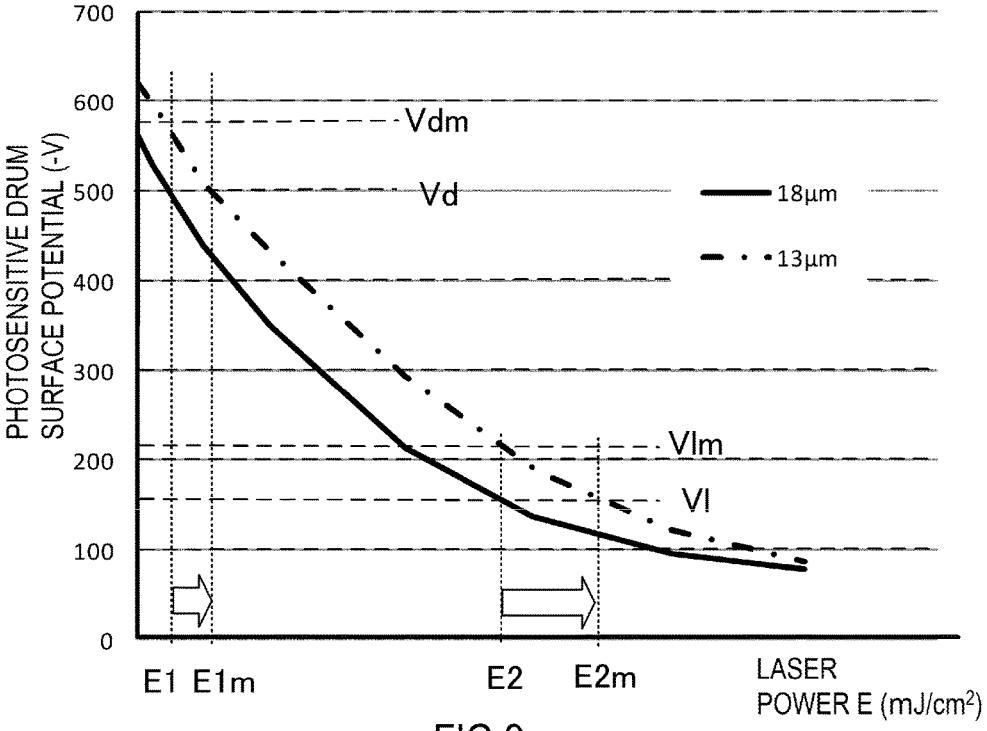
FIG. 9 is a diagram showing the relationship between the film thickness of the photosensitive drum and the laser power.

FIG. 9 is a diagram showing the relationship between the film thickness of the photosensitive drum 11 and the laser power. In concrete terms, FIG. 9 is an E-V curve for each film thickness of the photosensitive layer when the bias to be applied to the charging roller 12 (charging bias) is fixed to a predetermined value. The bias to be applied to the charging roller 12 is fixed to about −1150 (V). FIG. 9 shows the E-V curves of a photosensitive drum 11 of which film thickness of the photosensitive layer is 18 (μm), and a photosensitive drum 11 of which film thickness of the photosensitive layer is 13 (μm). As shown in FIG. 9, as the film thickness of the photosensitive layer of the photosensitive drum 11 decreases, the primary charging potential V0 increases, and the slope of the E-V curve changes.

In FIG. 9, in the case when the film thickness of the photosensitive layer is 18 (μm), the first exposure amount of the laser exposing unit 20 is set to E1=0.037 (μJ/cm$^2$), so that a desired non-image portion potential Vd is acquired. On the other hand, in the case when the film thickness of the photosensitive layer is 18 (μm), the second exposure amount of the laser exposing unit 20 is set to E2=0.25 (μJ/cm$^2$), so that a desired image portion potential VI is acquired. When the print test is performed up to when the film thickness of the photosensitive layer becomes 13 (μm), without changing the bias to be applied to the charging roller and the exposure amount of the laser exposing unit 20, both the non-image portion potential Vd and the image portion potential VI diverge from the target values. As shown in FIG. 9, the non-image portion potential becomes Vdm and the image portion potential becomes VIm. To match with the target values, the exposure amount to the non-image portion must be corrected from E1 to E1*m*, and the exposure amount to the image portion must be corrected from E2 to E2*m*. In FIG. 9, E1*m*=0.044 (μJ/cm$^2$), and E2*m*=0.30 (μJ/cm$^2$). In other words, in this example, control is implemented such that the first exposure amount and the second exposure amount are increased as the film thickness of the photosensitive drum 11 decreases, since the charging bias is not changed but is fixed to a predetermined value, even if the film thickness of the photosensitive drum 11 changes.

Figure 10:
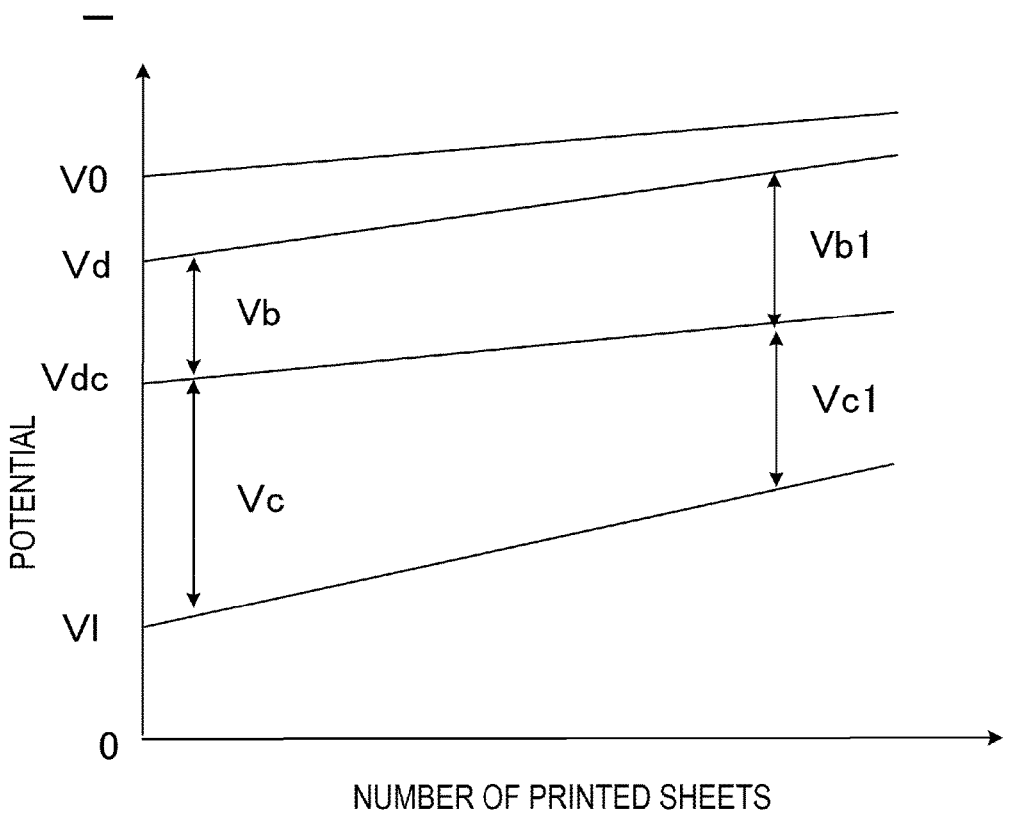
FIG. 10 is a diagram showing the relationship between the potential of the surface of the photosensitive drum and a number of printed sheets.

FIG. 10 is a diagram showing the relationship between the potential of the surface of the photosensitive drum 11 and a number of printed sheets. In FIG. 10, the bias to be applied to the charging roller 12 is fixed, and the exposure amount is not changed in accordance with the operation information (a number of printed sheets) of the photosensitive drum 11. FIG. 10 shows the changes of the non-image portion potential Vd and the image portion potential VI. The abscissa in FIG. 10 indicates the number of printed sheets. As the number of printed sheets increases, the film thickness of the photosensitive layer of the photosensitive drum 11 decreases.

As mentioned above, the non-image portion potential Vd and the image portion potential VI change as the E-V curve is changed by the change of the film thickness of the photosensitive layer. As a result, if the exposure amount is not changed in accordance with the operation information of the photosensitive drum 11, the white portion contrast Vb increases to Vb1, and the developing contrast Vc decreases to Vc1. This leads to a drop in the image quality, including quality in image density, fogging, line width and gradation.

In this example, in order to maintain the relationship between the white portion contrast Vb and the development contrast Vc, the non-image portion potential Vd, the image portion potential VI and the developing bias Vdc are constant regardless of the film thickness of the photosensitive drum 11. Thereby, a drop in the image quality, including quality in image density, fogging, line width and gradation, is suppressed. The control portion 100 stores the operation information of the photosensitive drum 11 in the cartridge memory 16, and determines the bias to be applied to the charging roller 12, the exposure amount to the non-image portion, and the exposure amount to the image portion in accordance with the operation information of the photosensitive drum 11.

<Characteristics of Embodiment>

Conventionally the non-image portion potential Vd after exposure, the potential Vdc of the developing roller 13, and the image portion potential VI after exposure are controlled to be constant values regardless of the film thickness of the photosensitive layer, so that image defects (e.g. fogging, transfer imperfections) are not generated, even if the film thickness of the photosensitive layer changes. In concrete terms, the bias to be applied to the charging roller 12 and the exposure amount to the photosensitive drum 11 are changed in accordance with the film thickness of the photosensitive layer.

In this example, however, the bias to be applied to the charging roller 12 must be changed so that the potential difference between the non-image portion on the photosensitive drum 11 and the charging roller 12 does not cause the later mentioned problems, not only due to the above mentioned relationship with the film thickness, but also due to the relationship with the humidity. In this case, if the exposure amount were not changed in accordance with the bias to be applied to the charging roller 12, the potential of the surface of the photosensitive drum 11, after being charged by the charging roller 12, would change. However, in order to reduce the image defects, the relationship between the white portion contrast Vb and the developing contrast Vc must be maintained, as mentioned above.

Therefore, in this example, the exposure amount to the photosensitive drum 11 is adjusted even if the bias to be applied to the charging roller 12 is changed in accordance with the absolute humidity, so that the non-image portion potential Vd after exposure is maintained to be a constant value. In this example, the potential difference between the charging roller 12 and the image portion is not considered, since the area of the image portion is much smaller than the area of the non-image portion on the surface of the photosensitive drum 11. In concrete terms, in this example, the control portion 100 controls the exposure amount of the laser exposing unit 20 and the bias to be applied to the charging roller 12.

Here the photosensitive drum 11 is charged by the discharge generated between the photosensitive drum 11 and the charging roller 12. In concrete terms, the discharge for charging the photosensitive drum 11 is mostly generated between the photosensitive drum 11 and the charging roller 12 at the upstream side in the rotating direction of the photosensitive drum 11, rather than the portion where the photosensitive drum 11 and the charging roller 12 are contacted. In a high temperature/high humidity (H/H) environment (temperature: 30° C./humidity: 80%), the discharge amount generated between the photosensitive drum 11 and the charging roller 12 increases if the potential difference between the surface of the photosensitive drum 11 and the charging roller 12 is large, since humidity is high. Because of this discharge, friction force between the photosensitive drum 11 and the drum cleaner 14 increases. This may cause a minute vibration of the drum cleaner 14, and generate an abnormal sound.

In a low temperature/low humidity (L/L) environment (L/L) (temperature: 15° C./humidity: 10%), on the other hand, a hardness of the drum cleaner 14 increases and the contact state between the surface of the photosensitive drum 11 and the drum cleaner 14 become unstable since humidity is low. If the potential difference between the surface of the photosensitive drum 11 and the charging roller 12 is small, the toner may fall through the gap between the surface of the photosensitive drum 11 and the drum cleaner 14, and adhere to the charging roller 12.

Therefore in this example, the potential difference between the surface of the photosensitive drum 11 and the charging roller 12 after the exposure at the first laser power E1 is increased as the absolute humidity in the image forming apparatus 1 decreases. Further, the potential difference between the surface of the photosensitive drum 11 and the charging roller 12 after the exposure at the first laser power E1 is decreased as the humidity in the image forming apparatus 1 increases.

In this example, the correspondence (first correspondence) of the bias to be applied to the charging roller 12, the first laser power E1, the thickness of the photosensitive layer of the photosensitive drum 11, and the humidity is stored in the cartridge memory 16. This correspondence is set such that the potential difference between the non-image portion and the charging member after the exposure increases as the humidity decreases, and decreases as the humidity increases. A discharge is also generated between the non-image portion and the primary transfer roller 31 after the exposure. Therefore the correspondence is set considering the discharge generated between the non-image portion of the photosensitive drum 11 and the primary transfer roller 31 as well. Based on this correspondence, the control portion 100 controls the bias to be applied to the charging roller 12 and the first laser power E1.

In this example, the control portion 100 controls the bias to be applied to the developing roller 13 so that the potential Vdc of the surface of the developing roller 13 becomes constant. The above mentioned correspondence of the bias to be applied to the charging roller 12, the first laser power E1, the thickness of the photosensitive layer, and the humidity, which is stored in the cartridge memory 16, is set such that the non-image portion potential Vd is constant. In this correspondence, the difference between the non-image portion potential Vd and the potential Vdc of the developing roller 13 is set to a potential difference by which not much fogging is generated on the photosensitive drum 11. The potential difference by which not much fogging is generated on the photosensitive drum 11 is experimentally determined in advance.

Further, in this example, a correspondence of the bias to be applied to the charging roller 12, the second laser power E2, the thickness of the photosensitive layer, and the humidity is also stored in the cartridge memory 16. The control portion 100 controls the second laser power E2 based on this correspondence. The correspondence of the second laser power E2, the thickness of the photosensitive layer and the humidity is set such that the image portion potential VI is constant. Further, the difference between the image portion potential VI exposed at the second laser power E2 and the potential Vdc of the developing roller 13 is set such that a development defect is not generated. However, the potential difference by which few development defects are generated is experimentally determined in advance.

FIG. 21 is a table for determining the bias to be applied to the charging roller 12 and the first laser power E1. In FIG. 21, W indicates the humidity, X indicates the film thickness of the photosensitive layer, Y indicates the bias to be applied to the charging roller 12, and Z indicates the first laser power E1. In Example 1, as shown in FIG. 21, the bias to be applied to the charging roller and the first laser power E1 are simultaneously determined from the humidity in the image forming apparatus 1 and the film thickness of the photosensitive layer using this table. Then based on the table shown in FIG. 21, the control portion 100 controls the bias to be applied to the charging roller 12 and the first laser power E1. The first laser power E1 as well is determined using a table similar to the table shown in FIG. 21.

Figure 11:
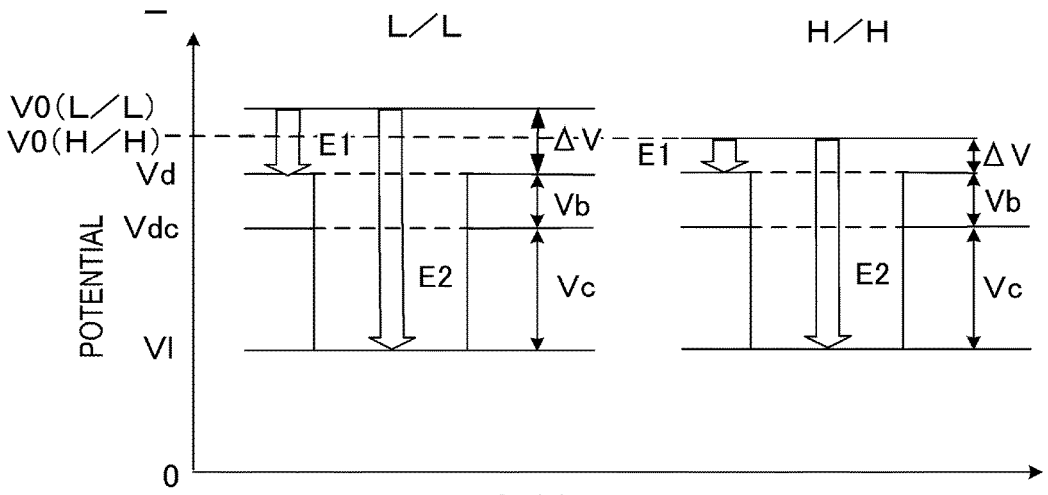
FIG. 11 is a diagram showing the potential difference between the surface of the charged photosensitive drum and the non-image portion.

FIG. 11 is a diagram showing the difference between the potential of the photosensitive drum 11 after charging when the above mentioned control was performed (primary charging potential V0) and the image portion potential VI and the non-image portion potential Vd of the photosensitive drum 11 after the exposure. In FIG. 11, the case when the absolute humidity is low (indicated by "L/L") and the case when the absolute humidity is high (indicated by "H/H"), with respect to the photosensitive drum 11 of which the film thickness of the photosensitive layer is a certain value, are shown side by side. In this example, as shown in FIG. 11, if the absolute humidity is low compared with the normal state, the bias to be applied to the charging roller 12 is increased compared with the normal state. If the absolute humidity is high compared with the normal state, on the other hand, the bias to be applied to the charging roller 12 is decreased compared with the normal state. Further, in this example, as shown in FIG. 11, the laser power of the laser exposing unit 20 is controlled such that the non-image portion potential Vd and the image portion potential VI have constant values even if the bias to be applied to the charging roller 12 is changed. In other words, if the absolute humidity is low compared with the normal state, the first laser power E1 and the second laser power E2 are increased compared with the normal state. If the absolute humidity is high compared with the normal state, the first laser power E1 and the second laser power E2 are decreased compared with the normal state. If the laser power of the laser exposing unit 20 is controlled in this way, the potential change ΔV, which is a difference between the primary charging potential V0 and the non-image portion potential Vd, becomes a different value in the L/L environment and in the H/H environment.

Figure 12:
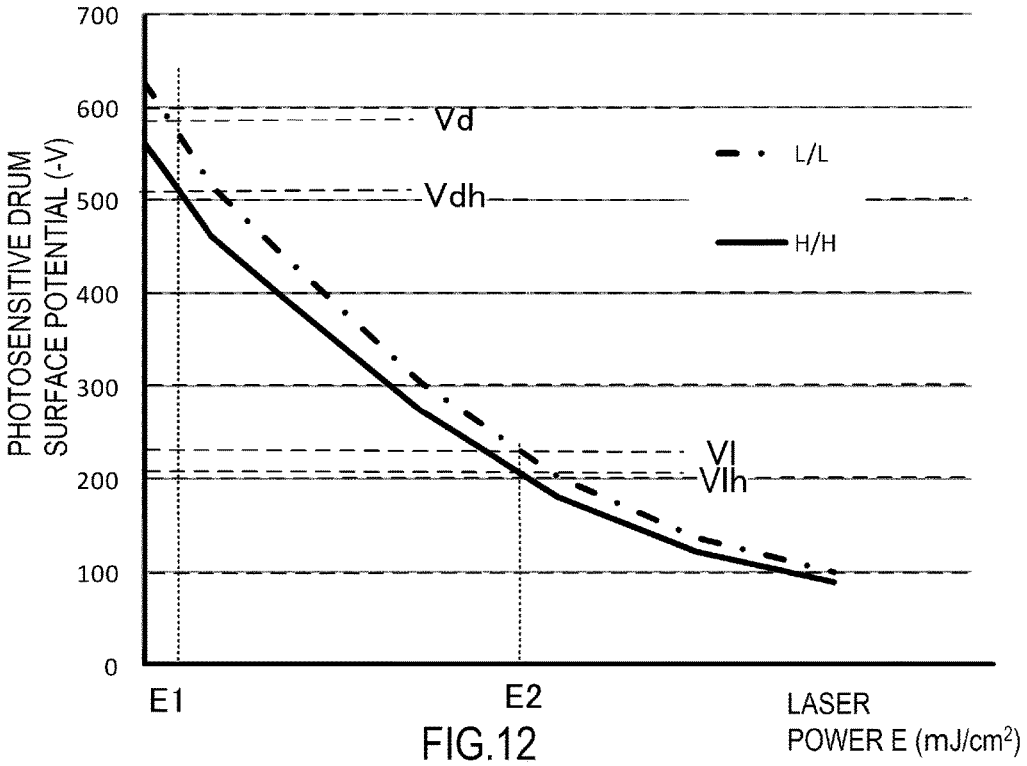
FIG. 12 is a diagram showing the relationship between the humidity in which the image forming apparatus is used and the laser power.

FIG. 12 is a diagram showing the relationship of the humidity in the image forming apparatus 1, the laser power and the photosensitive drum surface potential after the exposure. The potential of the surface of the photosensitive drum 11, in the case when the film thickness of the photosensitive drum 11 is constant and the absolute humidity is different, will be described in detail with reference to FIG. 12. Here a case when the film thickness of the photosensitive drum 11 is 18 μm will be described. In FIG. 12, the bias to be applied to the charging roller 12 is controlled such that the primary charging potential V0 becomes constant.

To make the primary charging potential V0 constant, the absolute value of the bias to be applied to the charging roller 12 must be set high in the L/L environment and low in the H/H environment, as shown in FIG. 7 and FIG. 8. If the laser power of the laser exposing unit 20 is not changed in accordance with the absolute humidity, as shown in FIG. 12, the non-image portion potential Vd and the image portion potential VI diverge from the target values. If the laser power is not changed, the non-image portion potential Vd becomes Vdh, and the image portion potential VI becomes VIh, as shown in FIG. 12.

If the absolute humidity is different, an error of the first laser power E1 larger than an error of the second laser power E2 is, due to the relationship of the EV sensitivity characteristic of the photosensitive drum, as shown in FIG. 12. The exposure amount to the non-image portion is smaller than the exposure amount to the image portion, hence the influence of an error of the exposure amount is great, even if the error is minor. Further, an error of the first laser power E1 exerts a major influence on the discharge start voltage Vth between the photosensitive drum 11 and the charging roller 12. The image portion potential VI is relatively stable even if the absolute humidity disperses, but the first laser power E1 must be optimized to stabilize the non-image portion potential Vd.

Therefore in this example, the values of the setting parameters (e.g. bias to be applied to the charging roller 12, exposure amount) are linearly interpolated in accordance with the absolute humidity. The control portion 100 controls the bias to be applied to the charging roller 12, the exposure amount to the non-image portion (first laser power E1) and the exposure amount to the image portion (second laser power E2) in accordance with the absolute humidity detected based on the signal outputted from the environmental sensor 300. Thereby the potential difference between the surface of the photosensitive drum 11, exposed at the first laser power E1 and the charging roller 12, is set to an optimum value. The potential difference between the surface of the photosensitive drum 11 exposed at the first laser power E1 and the charging roller 12 is adjusted such that discharge is decreased in the H/H environment, and discharge is increased in the L/L environment.

As mentioned above, in the H/H environment where the absolute humidity is high, the friction force between the photosensitive drum 11 and the drum cleaner 14 increases because of the discharge, and minute vibration is generated in the drum cleaner 14. As a result, an abnormal sound is generated. If the friction force between the photosensitive drum 11 and the drum cleaner 14 increases further, the drum cleaner 14 is warped. In this case, the drum cleaner 14 cannot clean the toner remaining on the photosensitive drum 11. Therefore in the H/H environment where the absolute humidity is high, it is preferable to decrease the discharge between the photosensitive drum 11 and the charging roller 12.

In the L/L environment where the absolute humidity is low, on the other hand, the hardness of the drum cleaner 14 increases, and the contact state between the surface of the photosensitive drum 11 and the drum cleaner 14 becomes unstable. If the toner on the photosensitive drum 11 passes through the gap between the drum cleaner 14 and the photosensitive drum 11, the toner adheres to the charging roller 12. In this case, the photosensitive drum 11 cannot be accurately charged. The toner that adheres to the charging roller 12 here is mainly transfer residual toner, which was not transferred to the intermediate transfer belt 30 during the primary transfer.

The transfer residual toner is charged to the positive polarity and attracted to the charging roller 12, which is charged to the negative polarity. As a result, the transfer residual toner electrically adheres to the charging roller 12. Therefore, the transfer residual toner on the photosensitive drum 11 is charged to negative polarity of the discharge between the charging roller 12 and the photosensitive drum 11, so that the transfer residual toner does not adhere to the charging roller 12. For this, the discharge between the charging roller 12 and the photosensitive drum 11 must be increased by making the potential difference between the charging roller 12 and the photosensitive drum 11 larger.

There are three types of discharge generated in the image forming apparatus 1: discharge generated when exposure is performed; discharge generated between the photosensitive drum 11 and the charging roller 12; and discharge generated between the photosensitive drum 11 and the primary transfer roller 31. In this example, a discharge is not generated between the developing roller 13 and the photosensitive drum 11, since the potential difference between the developing roller 13 and the photosensitive drum 11 is small. The discharge generated when the image portion of the photosensitive drum 11 is exposed is inevitable, because this discharge is necessary to supply toner from the developing roller 13 to the photosensitive drum 11. Therefore it is difficult to purposely decrease the discharge that is generated when the image portion of the photosensitive drum 11 is exposed. This is because image quality drops if development contrast Vc drops due to the decrease of the exposure amount.

The discharge between the photosensitive drum 11 and the primary transfer roller 31 is necessary to transfer the toner image from the photosensitive drum 11 to the intermediate transfer belt 30. Therefore it is difficult to purposely control the discharge between the photosensitive drum 11 and the primary transfer roller 31. If the discharge amount between the photosensitive drum 11 and the primary transfer roller 31 is decreased by decreasing the bias to be applied to the primary transfer roller 31, the potential difference between the surface of the photosensitive drum 11 and the primary transfer roller 31 becomes small in the primary transfer portion. This drops the accuracy of the primary transfer. As a consequence, it is preferable to control the discharge generated between the surface of the photosensitive drum 11, which was exposed at the first laser power E1, and the charging roller 12 when the image forming operation is not executed.

The discharge generated between the photosensitive drum 11 and the charging roller 12 after the primary transfer is generated after the photosensitive drum 11 receives the discharge from the primary transfer roller 31 and the toner image is transferred to the intermediate transfer belt 30, and after the primary transfer residual toner passed through the drum cleaner 14. Therefore the difference between the potential of the photosensitive drum 11 after the primary transfer (post-primary transfer potential Vt) and the potential of the charging roller 12 (referred to as charging contrast) contributes to the magnitude of the discharge.

Figure 13:
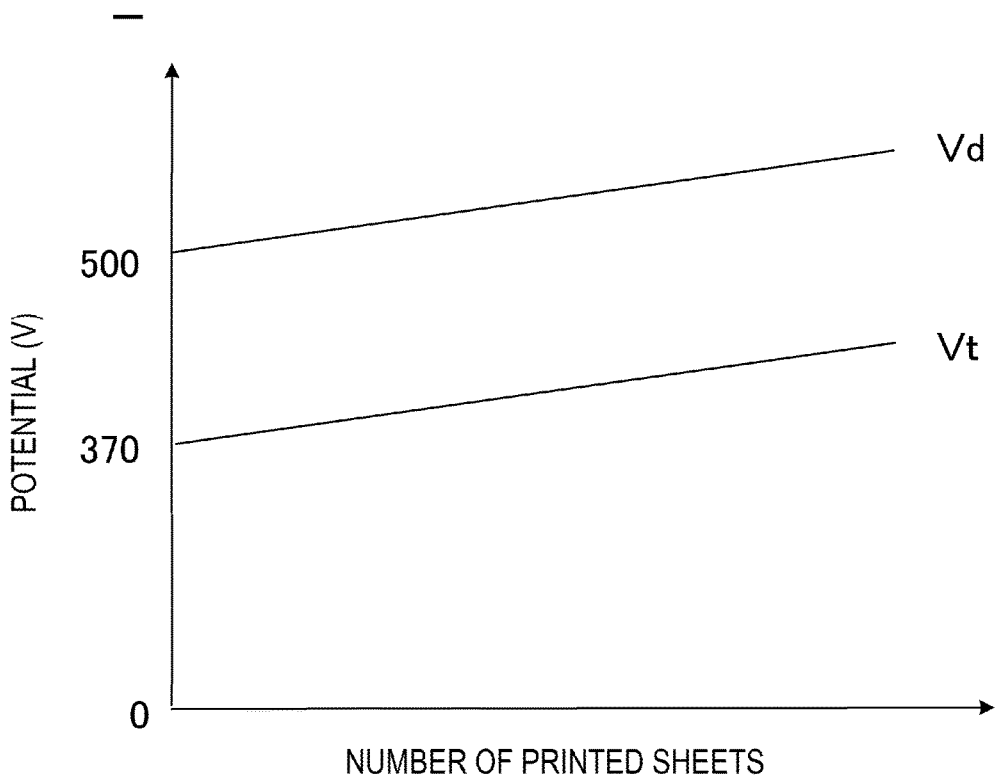
FIG. 13 is a diagram showing the relationship between the potential of the surface of the photosensitive drum and a number of printed sheets.

FIG. 13 is a diagram showing the relationship between the potential of the surface of the photosensitive drum 11 and a number of printed sheets. In FIG. 13, the post-primary transfer potential Vt is the potential of the surface of the photosensitive drum 11 after the primary transfer. In FIG. 13, the bias to be applied to the primary transfer roller 31 is +500 V. In FIG. 13 the abscissa is a number of printed sheets. As the number of printed sheets increases, the film thickness of the photosensitive drum 11 decreases. As shown in FIG. 13, the post-primary transfer potential Vt increases as the absolute value of the non-image portion potential Vd is higher, and the post-primary transfer potential Vt decreases as the absolute value of the non-image portion potential Vd decreases.

Therefore, if the non-image portion potential Vd is decreased and the bias to be applied to the charging roller 12 is increased, the difference between the post-primary transfer potential Vt and the potential of the charging roller 12 (charging contrast) can be increased. On the other hand, if the non-image portion potential Vd is decreased and the bias to be applied to the charging roller 12 is increased, then the charging contrast can be decreased. In this example, the difference of the post-primary transfer potential Vt and the potential of the charging roller 12 (charging contrast) is changed by maintaining the non-image portion potential Vd constant and changing the bias to be applied to the charging roller 12. If the bias to be applied to the charging roller 12 is simply increased, the non-image portion potential Vd becomes high, which causes a loss of the balance between the white portion contrast Vb and the development contrast Vc. These results in an insufficient developer area and an excess developer area generated in the developer image formed on the paper P.

In this example, this problem is solved by optimizing the exposure to the non-image portion (exposure at the first laser power E1). Here, the potential of the surface (non-image portion potential Vd) of the photosensitive drum 11 exposed at the first laser power E1 is maintained as constant by controlling the bias to be applied to the charging roller 12 and the exposure to the non-image portion. In this example, the first laser power E1 is controlled so that the non-image portion potential Vd becomes constant in accordance with the film thickness of the photosensitive layer of the photosensitive drum 11 and the absolute humidity.

As mentioned above, in this example, the potential difference between the surface of the photosensitive drum 11 exposed at the first laser power E1 and the charging roller 12 is increased as the absolute humidity in the image forming apparatus 1 decreases. Thereby the potential change ΔV (=|V0−Vd|), which is the difference between the primary charging potential V0 and the non-image portion potential Vd, changes as well. Further, by performing this control, the problems generated by the change of the absolute humidity can be minimized, and the image can be formed well. In this example, by performing the above mentioned control, the potential change ΔV in the H/H environment decreases, and the potential change ΔV in the L/L environment increases. In this example, it is assumed that the potential change ΔV is 50 V in the H/H environment (temperature: 30° C./humidity: 80%), and the potential change ΔV is 70 V in the L/L environment (temperature: 15° C./humidity: 10%).

In this example, the charging bias has a fixed even if the film thickness of the photosensitive drum 11 is changed, hence in order to make the non-image portion potential Vd constant, regardless of the change of the film thickness of the photosensitive drum 11, the exposure amount to the non-imaging portion must be changed. Further, in order to make the non-image portion potential Vd constant, whether the environment is L/L or H/H as well, the exposure amount to the non-image portion must be changed. As shown in FIG. 6, if the film thickness of the photosensitive drum 11 becomes thin, the exposure amount to the non-image portion is increased to set the non-image portion potential Vd to the target value. Moreover, as the absolute humidity decreases, the absolute value of the charging bias is set to a larger value, and as the absolute humidity increases, the absolute value of the charging bias is set to a smaller value. Therefore, as shown in FIG. 12, in order to set the non-image portion potential Vd to the target value, the exposure amount to the non-image portion is increased as the absolute humidity decreases.

Figure 14:
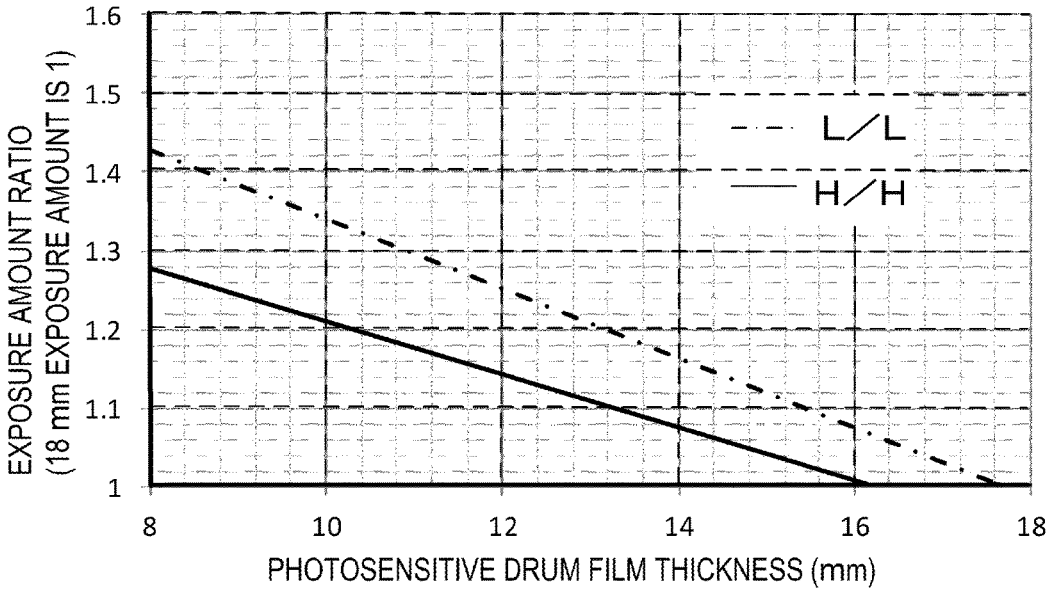
FIG. 14 is a diagram showing the relationship of the film thickness of the photosensitive drum, the humidity, and the exposure amount.
Figure 19:
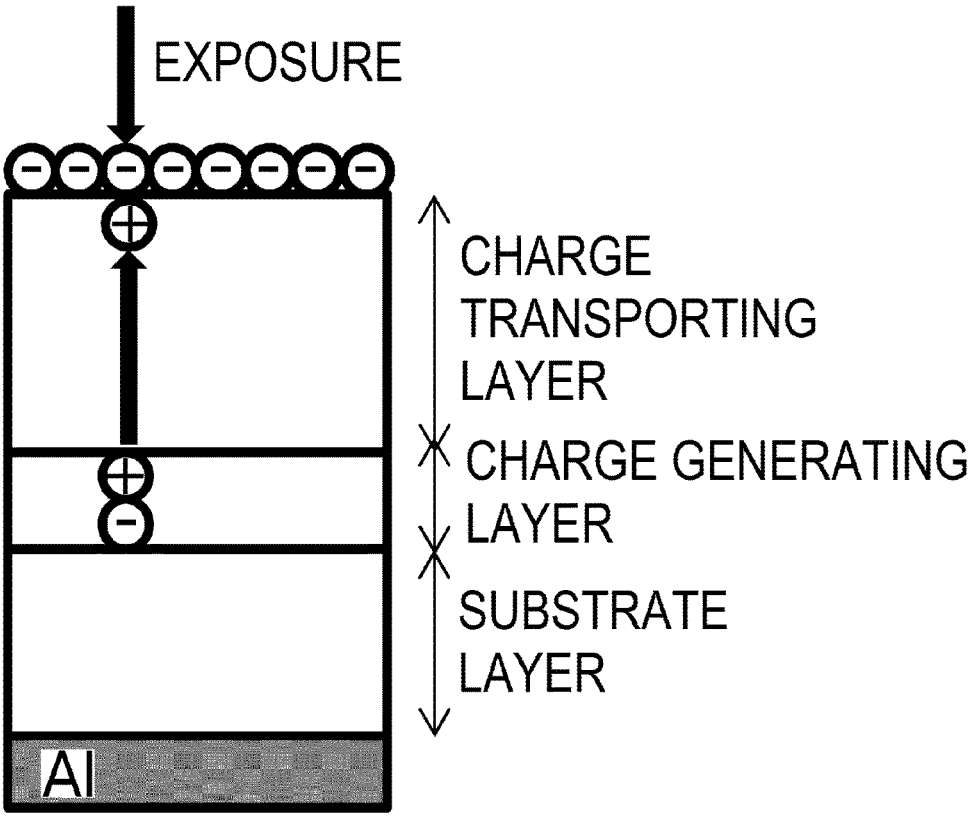
FIG. 19 is a diagram depicting a mechanism when the potential of the surface of the photosensitive drum changes by exposure.

In this way, the exposure amount of the non-image portion must be changed in accordance with the parameters of the film thickness of the photosensitive drum 11 and the absolute humidity. For example, if the film thickness of the photosensitive drum 11 becomes thin as the number of printed sheets increases, the exposure amount to the non-image portion must be corrected, in order to set the non-image portion potential Vd to the target value. In this case, it is necessary to read the information on the film thickness of the photosensitive drum 11 and the absolute humidity from the cartridge memory 16, and correct the exposure amount in accordance with the read information. Further, in this example, the change of the exposure amount with respect to the film thickness of the photosensitive drum 11 is larger in the L/L environment, compared with the H/H environment, as shown in FIG. 14. Thereby, even if the film thickness of the photosensitive drum 11 changes as the absolute humidity changes, the non-image portion potential Vd can be set to the target value.

The exposure amount may be adjusted such that the difference between the non-image portion potential Vd and the potential of the charging roller 12 increases as the film thickness of the photosensitive drum 11 decreases. The amount of the primary transfer residual toner, which is collected by the drum cleaner 14, accumulates as the film thickness of the photosensitive drum 11 decreases. In other words, the total amount of toner that passes through the gap between the charging roller 12 and the photosensitive drum 11 also increases, hence the contamination level of the charging roller 12 worsens as the number of printed sheets increases.

Therefore, in order to suppress the contamination of the charging roller 12, it is preferable that the discharge amount between the charging roller 12 and the photosensitive drum 11 is increased when the film thickness of the photosensitive drum 11 is thin, compared with the case when the film thickness is thick (initial state). If the difference between the non-image portion potential Vd and the potential of the charging roller 12 increases, the discharge between the charging roller 12 and the photosensitive drum 11 increases. Therefore, the difference between the non-image portion potential Vd and the potential of the charging roller 12 may be changed only in an environment where the contamination level of the charging roller 12 is serious.

<Function of this Example>

As described above, according to this example, the discharge amount between the photosensitive drum 11 and the charging roller 12 can be optimized by changing the difference between the non-image portion potential Vd and the potential of the charging roller 12 in accordance with the humidity. Now the contamination of the charging roller 12, generated in the L/L environment (temperature: 15° C./humidity: 10%), and the abnormal sound of the drum cleaner 14 that is generated in the H/H environment (temperature: 30° C./humidity: 80%), will be described.

The effect of minimizing the contamination of the charging roller 12 by toner will be described first. FIG. 15 shows a relationship between the humidity inside the image forming apparatus 1 and the contamination of the charging roller 12. In FIG. 15, the potential change ΔV is 50 V in the L/L and H/H environments. And the level of contamination of the charging roller 12 is compared after a print pattern, of which print ratio is 1%, is continuously printed for 2000 sheets. In FIG. 15, the level of contamination of the charging roller 12 is indicated by O when "no contamination", by Δ when "contaminated, but image is not affected", and by x when "contaminated and image is affected".

In the H/H environment where the absolute humidity is high, the contacting state of the drum cleaner 14 to the photosensitive drum 11 is good, and very little toner passes through the gap between the photosensitive drum 11 and the drum cleaner 14. Therefore no contamination is generated on the charging roller 12. Moreover, in the H/H environment, the electrical adhesive force of the toner to the charging roller 12 is weak. In the L/L environment where the absolute humidity is low, on the other hand, a lot of toner passes through the gap between the photosensitive drum 11 and the drum cleaner 14, and the charging roller 12 is contaminated by the toner. This means that the charging roller 12 is more easily contaminated by toner as the absolute humidity is lower. To suppress the contamination of the charging roller 12, the difference between the non-image portion potential Vd and the potential of the charging roller 12 must be optimized.

FIG. 16 shows the relationship between the potential difference in the non-image portion before and after the exposure and the contamination of the charging roller 12. In FIG. 16, the relationship between the difference of the non-image portion potential Vd and the potential of the charging roller 12 in the L/L environment, and the contamination of the charging roller 12 is shown. In FIG. 16, the level of contamination of the charging roller 12 is compared in the L/L environment after a print pattern, of which print ratio is 1%, is continuously printed for 2000 sheets. As the result in FIG. 16 shows, the level of contamination of the charging roller 12 is low as the potential difference between the post-primary transfer potential Vt and the potential of the charging roller 12 (charging contrast) is larger.

This means that if the charging contrast is large, the discharge between the photosensitive drum 11 and the charging roller 12 is increased, whereby the toner adhering to the charging roller 12 is effectively removed. In this example, it is assumed that the potential change is ΔV=70 V, as shown in FIG. 16. Thereby this example shows that a sufficient effect is acquired. In Comparative Example 1, on the other hand, the potential change is ΔV=50 V, and the level of contamination of the charging roller 12 is unacceptable. In Comparative Example 2, the potential change is ΔV=60 V, and the image is not affected, but the charging roller 12 is contaminated. As the difference between the non-image port ion potential Vd and the potential of the charging roller 12 changes, the potential change ΔV, which is the difference between the primary charging potential V0 and the non-image portion potential Vd, also changes.

Now the abnormal sound of the drum cleaner 14, generated by the discharge between the photosensitive drum 11 and the charging roller 12, will be described. FIG. 17 shows the relationship between the humidity inside the image forming apparatus 1 and the generation of the abnormal sound. In FIG. 17, a bias to be applied to the charging roller 12, the exposure amount by the laser exposing unit 20 (exposure mount to be ΔV=70 V) and the bias to be applied to the primary transfer roller 31 (+500 V) are set, as appropriate, for the L/L and H/H environments. Then the abnormal sounds of the drum cleaner 14, after the photosensitive drum 11 is rotated for two minutes, are compared with one another. The abnormal sound level is indicated by O when "no abnormal sound is generated", Δ when "a subtle abnormal sound is heard", and x when "a clear abnormal sound is heard".

In the L/L environment where the abnormal humidity is low, an abnormal sound is not generated since the friction force between the photosensitive drum 11 and the charging roller 12 does not increase. In the H/H environment where the absolute humidity is high, on the other hand, discharge is easily generated between the photosensitive drum 11 and the charging roller 12 because the amount of moisture is high. Therefore, the friction force between the photosensitive drum 11 and the charging roller 12 increases, and an abnormal sound is generated as a result. Since the abnormal sound of the drum cleaner increases as the absolute humidity increases, the difference between the non-image portion potential Vd and the potential of the charging roller 12 must be optimized to suppress the abnormal sound.

FIG. 18 shows the relationship between the difference of the non-image portion potential Vd and the potential of the charging roller 12, and the generation of abnormal sound. In FIG. 18, the correspondence of the abnormal sound level of the drum cleaner 14 and the difference of the non-image portion potential Vd and the potential of the charging roller 12 in the H/H environment is shown. In the H/H environment, the bias to be applied to the charging roller 12, the exposure amount by the laser exposing unit 20, and the bias to be applied to the primary transfer roller 31 (+500 V) are set so as to satisfy the conditions in FIG. 18 respectively. Then after rotating the photosensitive drum 11 for two minutes, the abnormal sounds of the drum cleaner 14 are compared with one another. As the result, in FIG. 18, the generation of abnormal sound is suppressed as the difference between the non-image portion potential Vd and the potential of the charging roller 12 (charging bias) is smaller.

This indicates that under the conditions of Example 1, a discharge is generated between the photosensitive drum 11 and the charging roller 12, but the friction force between the photosensitive drum 11 and the charging roller 12 did not increase high enough to generate abnormal sound. In this example, moreover, this indicates that a sufficient effect is acquired at the potential change ΔV=50 V. In Comparative Example 3, on the other hand, the potential change is ΔV=60 V, and abnormal sound starts to be generated from the drum cleaner 14. In Comparative Example 4, where the potential change is ΔV=70 V, abnormal sound is generated from the drum cleaner 14.

As described above, in this example, the exposure amount of the laser exposing unit 20 is controlled to be changed in accordance with the film thickness and the absolute humidity, and the absolute value of the charging bias to be applied to the charging roller 12 is changed in accordance with the absolute humidity. In concrete terms, under this control, the first exposure amount and the second exposure amount are increased as the film thickness decrease, the first exposure amount and the second exposure amount are increased as the absolute humidity is decreased, and the absolute value of the charging bias is increased as the absolute humidity decreases. In other words, the change of the film thickness is handled by control of at least the first exposure amount and the second exposure amount, and the change of the absolute humidity is handled by control of the charging bias, the first exposure amount and the second exposure amount. Thereby, the potential difference between the non-image portion and the charging roller 12 is increased as the humidity inside the image forming apparatus 1 decreases, and the potential difference between the non-image portion and the charging roller 12 is decreased as the humidity in the environment, where the image forming apparatus 1 is used, increases. As a result, the problems generated depending on the relationship between the potential difference of the image carrier (e.g. photosensitive drum) and the charging member (e.g. charging roller) and the humidity inside the image forming apparatus can be suppressed.

Example 2

Example 2 will be described next. In Example 2, a composing element having a same function as Example 1 is denoted with a same sign, and description thereof is omitted.

<Exposure to Non-Image Portion>

In Example 1, when the non-image portion is exposed, the output of the laser to expose the surface of the photosensitive drum 11 is switched between the first laser power (E1) and the second laser power (E2). The first laser power (E1) is weaker than the second laser power (E2). The technique to expose the surface of the photosensitive drum 11 in Example 1 is called "analog background exposure". An advantage of the analog background exposure is that the first laser power (E1) and the second laser power (E2) can be changed independently.

In Example 2, on the other hand, the non-image portion is exposed at the laser power (E2), the same as the laser power (E2) for the image portion, for a duration shorter than the duration to expose the image portion. This technique is called "digital background exposure". By digital background exposure, the non-image portion on the surface of the photosensitive drum 11 is exposed at a first exposure amount so as to generate a dark portion potential to prevent the adhesion of toner. This digital background exposure performs exposure at the first exposure amount by controlling not the emission brightness (power) of the laser but the emission duration, so as to generate the dark portion potential. Therefore, digital background exposure is effective when exposure at low light quantity (low brightness) cannot be performed due to the restrictions of the laser element used for the laser exposing unit 20 and the driving circuit thereof.

In the case of the background exposure method according to Example 1, the laser power must be changed in the range of the low laser power used for the background exposure to the high laser power used for forming a toner image. Further, the accuracy of the laser power is demanded for the entire region of the range where the laser power can change. Therefore, in order to expose the photosensitive drum 11 using the background exposure method, an expensive laser element and driving circuit must be used.

In Example 2, the exposure amount to the surface of the photosensitive drum 11 is changed by changing not the laser power of the laser exposing unit 20, but the duration of exposure. This makes it unnecessary to use an expensive laser element. Moreover, the sensitivity of the photosensitive drum 11 becomes more stable if the photosensitive drum 11 is exposed at high laser power.

<Other>

In each example, the image forming apparatus that uses reversal development was described, but the present invention is not limited to this. For example, an image forming apparatus that uses normal development, where the charging polarity of the photosensitive drum 11 and the charging polarity of toner are the opposite during image formation, may be used.

In each example, a full color (four colors) image forming apparatus was described, but the present invention is not limited to this. For example, a technique related to each example can also be applied to a monochrome (single color) image forming apparatus.

In the above mentioned examples, the change of the film thickness of the photosensitive drum 11 is handled by changing the first exposure amount and the second exposure amount, but may also be handled by controlling the absolute value of the charging bias. In this case, the absolute value of the charging bias is controlled to be smaller as the film thickness of the photosensitive drum 11 decreases, so that the non-image portion potential Vd after the exposure and the image portion potential VI after the exposure become constant, even if the values of the first exposure amount and the second exposure amount are fixed with respect to the change of the film thickness. In addition to this handling of the change of the film thickness by controlling the charging bias, the change of the charging bias and the absolute humidity may also be handled just like the above examples.

In concrete terms, the first exposure amount and the second exposure amount are increased as the absolute humidity decreases, the absolute value of the charging bias is decreased as the film thickness decreases, and the absolute value of the charging bias is increased as the absolute humidity decreases. In this way, the change of the film thickness may be handled by controlling at least the charging bias, and the change of the absolute humidity may be handled by controlling the charging bias, the first exposure amount, and the second exposure amount.

A common high voltage power supply may be used to apply bias to the charging rollers 12Y to 12K, and a common high voltage power supply may be used to apply bias to the developing rollers 13Y to 13K. In this case, the image forming apparatus 1 can be downsized and the cost thereof reduced since the number of power supplies can be decreased. Further, in each process cartridge 10, a same bias may be applied to the charging rollers 12Y to 12K, and a same bias may be applied to the developing rollers 13Y to 13K.

<Charging High Voltage Power Supply>

Figure 20:
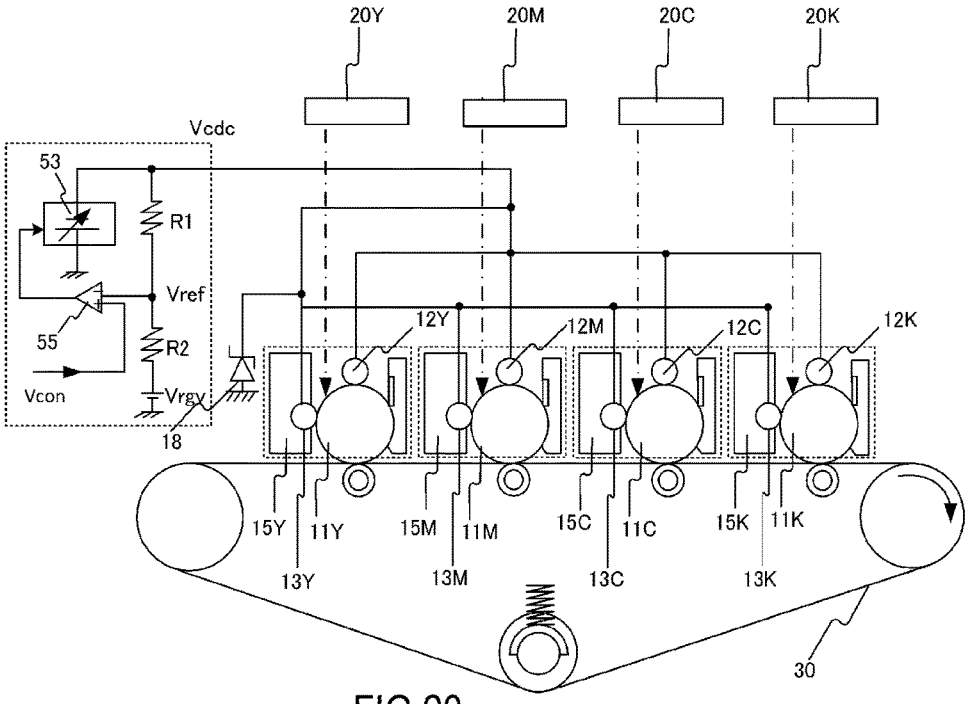
FIG. 20 is a diagram depicting an electric circuit to apply bias to the charging roller.

A charging high voltage power supply 53 will be described with reference to FIG. 20. FIG. 20 is a diagram depicting an electric circuit to apply bias to the charging roller 12. FIG. 20 shows only the key portions of the image forming apparatus 1 depicted in FIG. 1. In FIG. 20, such a member as the transfer cleaning apparatus 19 is not illustrated. In FIG. 20, a composing element having a same function as FIG. 1 is denoted with a same sign, and description thereof is omitted.

The charging high voltage power supply 53 is constituted by a transformer and a transformer driving and controlling system. In FIG. 20, the charging rollers 12Y to 12K are connected to the charging high voltage power supply 53, and the charging high voltage power supply 53 supplies the charging voltage Vcdc (power supply voltage) outputted from the negative transformer to the charging rollers 12Y to 12K. In other words, one charging high voltage power supply 53 is used for the power supplies to supply voltage to the charging rollers 12Y to 12K. Therefore, in the power supply circuit in FIG. 20, the voltages that are applied from the charging high voltage power supply 53 to the charging rollers 12Y to 12K can be adjusted in batch. However, the charging rollers 12Y to 12K cannot be adjusted independently.

Here, in order to control the charging voltage Vcdc to be approximately constant, a monitor voltage Vref is generated by offsetting the negative voltage, which was generated by stepping down the charging voltage Vcdc at R2/(R1+R2), to the voltage having the positive polarity by the reference voltage Vrgv. Then feedback control is performed so that the monitor voltage Vref becomes a constant value. In concrete terms, a control voltage Vcon that is set by the control portion 100 in advance, is inputted to the positive terminal of the operational amplifier 55, and the monitor voltage Vref is inputted to the negative terminal. The control portion 100 changes the control voltage Vcon each time conditions change. Then, the control portion 100 performs feedback control of the control driving system of the transformer using the output value of an operational amplifier 55, so that the monitor voltage Vref and the control voltage Vcon become the same. Thereby, the charging voltage Vcdc, outputted from the transformer, is controlled to be a target value.

Here each of the resistance elements R1 and R2 may be constituted by any one of: a fixed resistor; a semi-fixed resistor; and a variable resistor. In FIG. 20, the charging high voltage power supply 53 directly inputs the power supply voltage from the transformer to the charging rollers 12Y to 12K, but the present invention is not limited to this input format. Various input formats are possible for the charging roller 12 and the developing roller 13, respectively. For example, instead of output from the transformer, a converted voltage, generated by DC-DC converting the output from the transformer by a converter, or voltage generated by dividing or stepping down the power supply voltage or converted voltage using an electronic element having a fixed voltage dropping characteristic, may be inputted to the charging rollers 12Y to 12K.

For the electronic element having a fixed voltage dropping characteristic, a resistance element, a Zener diode or the like may be used. The converter includes a variable regulator. The meaning of above mentioned phrase "dividing or stepping down using an electronic element" includes further stepping down the divided voltage or vice versa. To control the output of the transformer, the output of the operational amplifier 55 may be inputted to the control portion 100, so that the computing result by the control portion 100 is reflected in the control and driving system of the transformer.

Now the high voltage power supply to apply bias to the developing rollers 13Y to 13K will be described. A voltage stabilizing element is connected to the developing roller 13, to apply high voltage from the charging high voltage power supply 53 to the developing roller 13. The voltage applied to the developing roller 13 is smaller than the voltage required by the charging high voltage power supply 53. Therefore it is sufficient if the voltage stabilizing element is connected to the developing roller 13. For the voltage stabilizing element, a Zener diode, a varistor or the like is preferable. Here the voltage to be applied to the charging roller 12 and the voltage to be applied to the developing roller 13 are common. However, the voltage to be applied to the charging roller 12 and the voltage to be applied to the developing roller 13 may be independent from each other.

As described above, in Example 2, the problems generated depending on the relationship between the potential difference of the non-image portion and the charging roller 12, and the humidity inside the image forming apparatus 1 can be suppressed, just like Example 1. Further, in Example 2, the laser exposing unit 20 changes the exposure amount to the surface of the photosensitive drum 11 by changing the duration of exposing the surface of the photosensitive drum 11 without changing the output of exposure. Thereby, the manufacturing cost of the image forming apparatus 1 can be reduced, since an expensive laser exposing unit 20 need not be used.

In each example, the image carrier where a toner image is formed need not be the photosensitive drum 11. The shape and the like of the image carrier are not limited as long as a toner image is formed thereon. In each example, the charging member to charge the photosensitive drum 11 need not be the charging roller 12. The shape and the like of the charging member are not limited, as long as the photosensitive drum 11 can be charged. In each example, the transfer member to transfer the toner image on the photosensitive drum 11 to the intermediate transfer belt 30 need not be the primary transfer roller 31. The shape and the like of the transfer member are not limited, as long as the toner image on the photosensitive drum 11 can be transferred to the intermediate transfer belt 30.

In each example, the bias to be applied to the charging roller 12 and the exposure amount of the laser exposing unit 20 are determined based on the table stored in the cartridge memory 16, the film thickness of the photosensitive drum 11, and the humidity. However, the present invention need not be limited to this. For example, the bias to be applied to the charging roller 12 and the exposure amount of the laser exposing unit 20 may be determined based on the film thickness of the photosensitive drum 11 and the humidity using a calculation formula.

In each example, the bias to be applied to the charging roller 12 and the exposure amount of the laser exposing unit 20 are determined based on the table stored in the memory 16, the film thickness of the photosensitive drum 11, and the humidity. However, the present invention need not be limited to this. For example, the bias to be applied to the charging roller 12 and the exposure amount of the laser exposing unit 20 may be determined based on the film thickness of the photosensitive drum 11 and the humidity using a calculation formula.

In each example, the film thickness of the photosensitive layer of the photosensitive drum 11 is measured based on the number of fed sheets, but the present invention need not be limited to this. For example, the film thickness of the photosensitive layer of the photosensitive drum 11 may be measured based on the total number of rotations of the photosensitive drum 11, or on the potential of the surface of the photosensitive drum 11.

According to the present invention, problems that occur when the discharge amount generated between the image carrier, such as a photosensitive drum 11, and the charging member, such as a charging roller 12, is changed by humidity can be minimized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-195242, filed on Sep. 30, 2015, which is hereby incorporated by reference herein in its entirety.

What is claimed is:

1. An image forming apparatus for forming an image on a recording medium, the image forming apparatus comprising:

a photoreceptor;

a charging member configured to charge a surface of the photoreceptor;

an exposing device configured to expose:

a non-image forming portion on the surface of the photoreceptor, where a developer image is not formed, at a first exposure amount; and an image forming portion on the surface of the photoreceptor, where the developer image is formed, at a second exposure amount larger than the first exposure amount;

a developing member configured to supply developer to the surface of the photoreceptor to form the developer image on the surface of the photoreceptor; and a control portion configured to control the exposing device, wherein the control portion controls the first exposure amount so that a potential difference between the non-image forming portion and the charging member increases as absolute humidity inside the image forming apparatus decreases, and decreases as the absolute humidity increases.

2. The image forming apparatus according to claim 1, further comprising:

a storing portion configured to store a first correspondence of the first exposure amount and the absolute humidity, wherein the first correspondence is a correspondence in which the potential difference between the non-image forming portion exposed at the first exposure amount and the charging member increases as the absolute humidity decreases, and decreases as the absolute humidity increases, and the control portion controls the first exposure amount based on the first correspondence.

3. The image forming apparatus according to claim 2, further comprising:

a storing portion in which a second correspondence of the second exposure amount and the absolute humidity is stored, wherein the control portion controls the second exposure amount based on the second correspondence.

4. The image forming apparatus according to claim 1, wherein:

the developing member includes a developer carrier that carries the developer, the image forming portion formed on the surface of the photoreceptor is developed by movement of the developer electrically from the developer carrier to the image forming portion formed on the surface of the photoreceptor, a developing bias to be applied to the developer carrier is constant, and the control portion controls the first exposure amount so that potential of the non-image forming portion is constant.

5. The image forming apparatus according to claim 4, wherein the control portion controls a potential difference between the non-image forming portion and the developer carrier so that fogging is not generated on the photoreceptor.

6. The image forming apparatus according to claim 4, wherein:

the control portion controls the second exposure amount with respect to the absolute humidity, and the control portion controls the second exposure amount so that potential of the image forming portion is constant.

7. The image forming apparatus according to claim 6, wherein the control portion controls a potential difference between the image forming portion and the developer carrier so that insufficient developer and excess developer do not occur to the developer image formed on the recording medium.

8. The image forming apparatus according to claim 1, further comprising:

a humidity sensor configured to detect humidity inside the image forming apparatus, wherein the control portion acquires a value of the absolute humidity inside the image forming apparatus, based on an output of the humidity sensor.

9. The image forming apparatus according to claim 1, wherein the exposing device changes an exposure amount to the photoreceptor by changing the output of exposure without changing duration of exposing the photoreceptor.

10. The image forming apparatus according to claim 1, wherein the exposing device changes an exposure amount to the photoreceptor by changing duration of exposing the photoreceptor without changing the output of exposure.

11. The image forming apparatus according to claim 1, wherein the control portion controls the first exposure amount and the second exposure amount so that the first exposure amount and the second exposure amount increase as a film thickness of the photoreceptor decreases.

12. The image forming apparatus according to claim 11, wherein a charging bias to be applied to the charging member is fixed to a predetermined value under a fixed absolute humidity without depending on a film thickness of the photoreceptor.

13. The image forming apparatus according to claim 1, wherein the absolute humidity ($g/m^3$) is acquired based on saturated moisture amount Wmax ($g/m^3$) at environmental temperature, which is calculated by the following expression, using the saturated moisture amount Wmax and an environmental humidity RH (%):

$$\text{Absolute humidity}(g/m^3)=W\text{max}\times(\text{RH}/100).$$

14. The image forming apparatus according to claim 13, wherein the environmental humidity is calculated by the following expression, using the environmental humidity RH5(%) at 5° C. and the environmental humidity RH50(%) at 50° C. and the environmental temperature T (° C.):

$$\text{Environmental humidity (\%)}=RH50+(50-T)\times((RH5-RH50)/(50-5)).$$

15. An image forming apparatus for forming an image on a recording medium, the image forming apparatus comprising:

a plurality of image forming units each comprising:

a photoreceptor;

a charging member configured to charge a surface of the photoreceptor; and a developing member configured to supply developer to a surface of the photoreceptor to form a developer image on the surface of the photoreceptor;

an exposing device configured to expose:

a non-image forming portion on the surface of the photoreceptor, where a developer image is not formed, at a first exposure amount; and an image forming portion on the surface of the photoreceptor, where the developer image is formed, at a second exposure amount larger than the first exposure amount;

a common power supply configured to apply a charging bias to each of the charging members; and a control portion configured to control the exposing device, wherein the control portion controls the first exposure amount so that a potential difference between the non-image forming portion on the surface of each of the photoreceptors and each of the charging members increases as absolute humidity inside the image forming apparatus decreases, and decreases as the absolute humidity increases.

* * * * *